United States Patent [19]

Jordan et al.

[11] 4,016,692

[45] Apr. 12, 1977

[54] COMPOSITE PAVING STRUCTURES AND LAYING UNITS THEREFOR

[75] Inventors: Reinhard Jordan, Baden-Baden; Fritz von Langsdorff, Stuttgart, both of Germany

[73] Assignee: F. von Langsdorff Bauverfahren GmbH, Rastaat, Germany

[22] Filed: Apr. 25, 1975

[21] Appl. No.: 571,520

Related U.S. Application Data

[63] Continuation of Ser. No. 407,253, Oct. 17, 1973, abandoned.

[30] Foreign Application Priority Data

| | | |
|---|---|---|
| Oct. 20, 1972 | Germany | 2251621 |
| Dec. 5, 1972 | Germany | 2259493 |
| July 25, 1973 | Germany | 2337816 |

[52] U.S. Cl. ..... 52/314; 52/589; 52/604

[51] Int. Cl.[2] ..... E04C 1/10

[58] Field of Search ..... 52/604, 608, 609, 591, 52/592, 594, 98, 100, 589, 590, 593, 314; 404/41–46

[56] References Cited

UNITED STATES PATENTS

| | | | |
|---|---|---|---|
| 1,700,542 | 1/1929 | O'Donnell | 52/98 |
| 1,740,110 | 12/1929 | Oden | 52/98 |
| 1,828,193 | 10/1931 | Levin | 52/314 X |
| 1,853,824 | 4/1932 | Krauss | 52/314 |
| 1,895,801 | 1/1933 | Keller | 52/591 |
| 3,304,673 | 2/1967 | Ramoneda | 52/314 X |

FOREIGN PATENTS OR APPLICATIONS

| | | | |
|---|---|---|---|
| 20,682 | 1/1961 | Germany | 404/41 |

*Primary Examiner*—Price C. Faw, Jr.
*Assistant Examiner*—Carl D. Friedman
*Attorney, Agent, or Firm*—Albert C. Johnston; Gerard F. Dunne

[57] ABSTRACT

The invention relates to a composite paving structure consisting of elements forming a pattern. The structure is made up of laying units each of which has a group of elements adjoining at their respective peripheries and held together by predetermined rupture zones. Supplementing stones are disposed at the boundaries of adjacent units. The stones have one or more elements and extend, in each case, into recesses in both of two adjacent units. Preferably, the stones are of one shape and the pattern is a herringbone pattern. The units may be offset relative to one another in the herringbone pattern.

41 Claims, 27 Drawing Figures

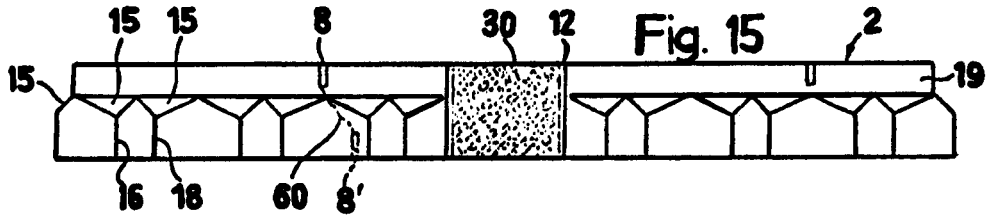
Fig. 15
Fig. 14
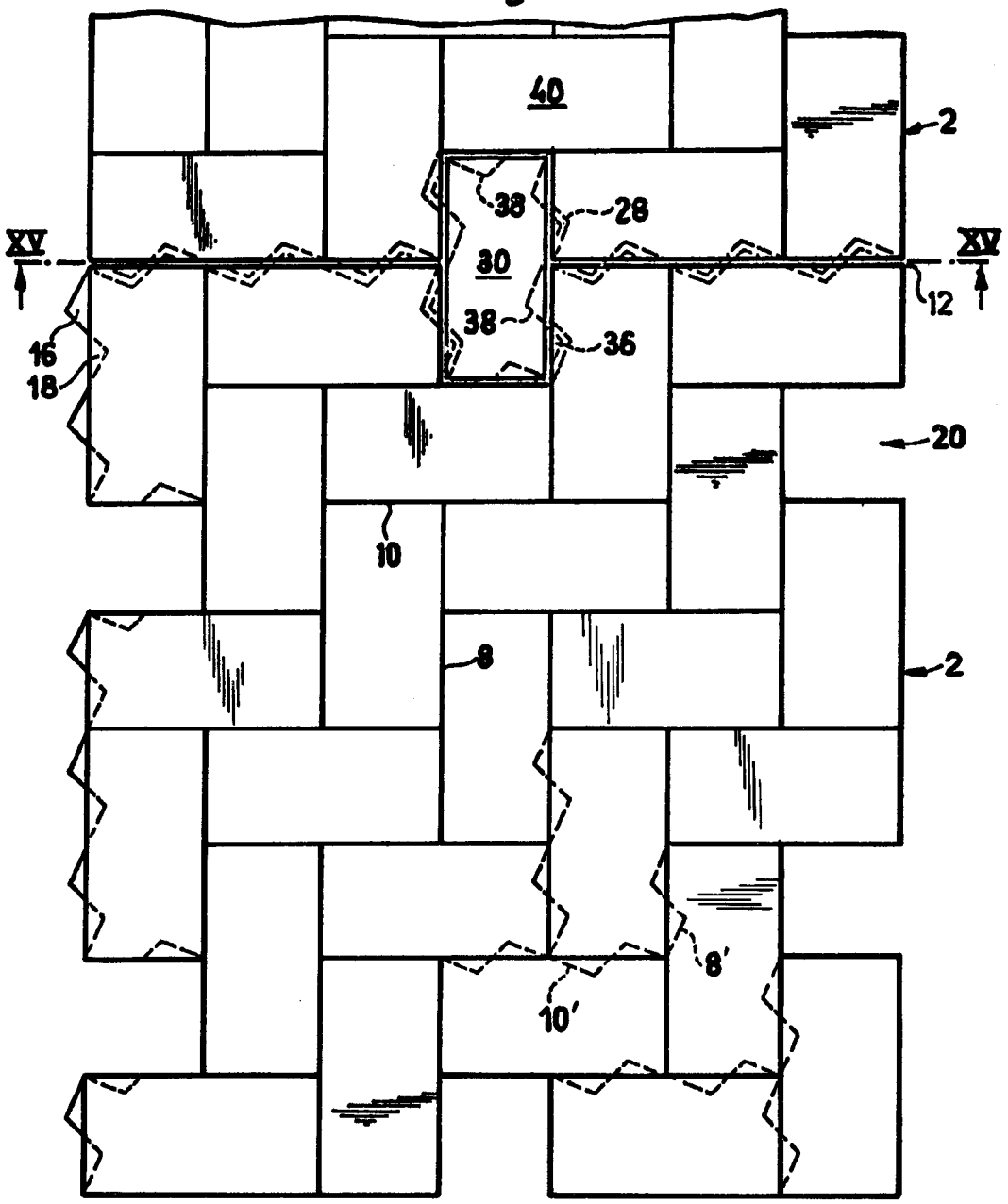

COMPOSITE PAVING STRUCTURES AND LAYING UNITS THEREFOR

This is a continuation of application Ser. No. 407,253 filed Oct. 17, 1973, now abandoned.

This invention relates to composite paving structures constructed primarily of units (herein generally termed "laying units") placed or laid in position, and it relates also to such units and to processes and a device for making them and to processes for laying them to form such structures.

Paved surfaces are known that are constructed by laying relatively large slabs or laying units on a prepared substructure. The placing of such units involves a measure of difficulty by reason of their large size and consequent heavy weight. Accurate positioning cannot readily be effected manually. An object of the invention is to provide improved composite structures and improved units and processes for constructing such structures.

According to one of its aspects the invention provides a composite paving structure comprising paving elements or stones forming a pattern, the structure being made up of laying units respectively having a group of the paving elements adjoining at their respective peripheries and held together by predetermined rupture zones, with supplementing (linking) stones disposed at the boundaries of adjacent laying units, the supplementing or linking stones respectively having the shape of one or more of the paving elements and extending in each case into recesses in both of said adjacent units.

According to a second aspect the invention provides a laying unit for a structure as described above wherein the unit has recesses spaced along its periphery and extending the full height of the unit for reception of supplementing stones.

According to another aspect the invention provides a process for laying a plurality of units as described above to form a structure as described above, the process including the steps of engaging gripper means of a gripper device in recesses of the unit, lifting the unit by way of the gripper device, depositing the unit on a prepared bed adjacent units that have already been laid spaced therefrom by the width of a jointing gap and withdrawing the gripper means from the unit.

Since, in the case of laying units for inclusion in such composite structures the individual elements first of all cohere by way of still unruptured predetermined rupture zones, the laying units can be taken up as a single whole without use of lateral pressure, in particular mechanically and can be set down at the desired laying location. After the composite structure has been laid, rupture along the predetermined rupture zones is initiated, for example by jarring with an eccentric-weight percussion device, or by stressing or loading due to traffic, or due to thermal stressing. With this arrangement, the roughness of the ruptured faces and also the sand swept into the jointing gaps, for example a sand having a maximum grain size corresponding to the width of the jointing gaps, provide a certain degree of connecting effect of the individual elements also after rupture.

Such predetermined rupture zones can extend either perpendicular to the surface of the laying unit or at an angle thereto. If predetermined rupture zones are provided extending in varying directions as seen in plan view of the laying unit, for example in zig-zag form or in undulating form, a horizontal connection is produced well able to transmit forces; in the case of predetermined rupture zones inclined at an angle to the surface of the laying unit, an especially effective vertical connection of the individual elements is achieved. Additionally, it is possible to combine the horizontal and vertical connecting effect.

The composite structure when laid exhibits a uniform appearance, and that the structure is made up of an assembly of laying units and supplementing stones is, depending on the similarity of the jointing gap, hardly recognizable or not recognizable at all if they are identical.

Since, in the case of a large-area composite structure, it is necessary to have a relatively large number of supplementing stones, it is preferred that all the supplementing stones should have the same shape. To cater for considerable variation of stresses in the composite structure in different directions, supplementing stones of appropriate shape, thickness and/or quality, can be selected depending on the degree of stressing in the location concerned.

Such a pattern may for example be a cross-bond pattern or a parquet bond pattern; however, it is especially advantageous to select a herringbone pattern since this results in a horizontal bond of the elements relative to each other which resists horizontal thrust in all directions. In the case of the herringbone bond pattern, there are no continuous jointing gaps in any one direction, so that settlement or lateral displacement along gaps extending over a relatively large distance are prevented.

Similar considerations apply, in larger measure, to the arrangement of the laying units themselves relative to each other, since there are in fact genuine jointing gaps between them. In a further development of the invention the laying units are offset relative to each other, being for example also themselves laid in the manner of a herringbone bond structure. However, there are also many other possibilities for arranging the laying units to be offset relative to each other, for example in brickwork bond structure, a cross-bond structure, or a so-called parquet bond structure.

According to a further development of the invention, the recesses facing each other and the supplementing stone inserted in each particular instance have projections and withdrawn portions in the horizontal direction engaging at least partially one behind the other and connecting the adjacent laying units, transversely of the intermediate jointing gap, to be fast against tension. Such a mode of connecting the adjacent laying units with each other to be fast against tension is to be recommended in the case of considerable traffic loading due to heavy vehicles, covering of substrates of a difficult nature, for example such as tend to settle or yield, or covering inclined surfaces such as harbor embankments, or the like. The projections and withdrawn portions may each exhibit contours of rectilinear, trapezoidal, sinusoidal or any other rectilinear or curvilinear shape. Especially preferred is a contour of the recesses into which already known and commercially available stones, for example of simple double-T shape, can be inserted as supplementing stones, and also an axis-symmetrical or central-symmetrical design of the recesses. The supplementing stones subjected to tensile stressing may, in the case of special requirements, also be provided with steel reinforcement.

In simpler cases, recesses having the shape of an open rectangle may suffice, thereby providing a thrust-resisting connection of the laying units in the direction of the intermediate jointing gap.

Especially if the composite structure has laying units each consisting of a plurality of elements cohering by way of predetermined rupture zones that are inclined relative to the surface of the laying unit, and if furthermore the laying units are formed at their outer periphery with means for mutual vertical toothed engagement, vertical bonding of the laying units may be attempted in the regions of the inserted supplementing stones, so far as readily feasible. In further development of the invention, therefore, the facing recesses and the inserted supplementing stones have protuberances and recessed parts which at least partially engage over each other and so as to limit displacement of the particular supplementing stone relative to the adjacent laying units at least in one vertical direction.

It is possible so to design the interengaging protuberances and recessed parts, for example in the manner of tongue and groove connection, that displacement of the supplementing stone relative to the adjacent laying units is limited in both vertical directions. In this case however the supplementing stone must be pushed at least obliquely from the front into the recess thereby making laying of the entire composite structure more difficult.

Consequently, it is preferred so to design the protuberances and recessed parts at the inner contour of the recesses and at the periphery of the supplementing stone either in such manner that the supplementing stone can be inserted from below into the facing recesses of the adjacent laying units or that the supplementing stone can be inserted from above. Which mode of design is to be preferred depends on the expected principal direction of stressing of the composite structure. If for example it is to be expected that the greater degree of stressing will be applied from above, due to heavy wheel loads, provision will be made for insertion of the supplementing stone from above. If however a high degree of stressing of the composite structure from below is expected, for example due to reaction thrust, it may be more advantageous to insert the supplementing stone from below.

The terms "protuberance" and "recessed part" are herein in general used to mean that at the relevant locations the contour of the recess or of the supplementing stone does not extend vertically, but that in the vertical direction, as seen from above, material projecting over an imaginary vertical contour face is located opposite material removed from such a vertical contour face. Similarly, the terms "projection" or "withdrawn portion" are herein in general used to mean that at the relevant location the contour of the recess or of the supplementing stone does not extend along a vertical plane perpendicular to the open side of the recess, but that, as seen in the horizontal direction, material is provided which projects beyond the said imaginary vertical plane or material which has been removed relative to such a vertical plane.

It is pointed out that the boundary or contour of the projections and withdrawn portions and also of the protuberances and withdrawn parts may have any desired rectilinear or curvilinear configuration. In particular, a wedge bounded by a vertical face extending obliquely relative to the open side of the recess is considered to constitute a limit case of a projection or withdrawn portion, and a wedge bounded by an oblique face inclined relative to the surface of the composite structure, extending perpendicular to the open side of the recess and extending along the entire height of the laying unit is considered to constitute a limit case of a protuberance or recessed part.

The boundary faces, serving as toothed engagement faces, of the projections and withdrawn portions or of the protuberances and recessed parts may be designed as faces extending perpendicular to the particular stressing direction, i.e. parallel to the open side of the recess or horizontal. For reasons connected with the static strength of the composite structure, however, it is advantageous if the vertical toothed-engagement faces form an angle with the upper side of the composite structure and the horizontal toothed engagement faces form an angle with the open side of the recess. If the toothed-engagement faces were to be designed to extend perpendicular to the corresponding direction of stressing, there would be formed, at the location of opening into the remaining contour of the recess or of the supplementing stone, a cross-section which would be greatly endangered by stress concentration. This stress concentration is greatly diminished by inclined formation of the relevant toothed-engagement faces.

If it is desired to achieve, at the locations of the composite structure provided with inserted supplementing stones, both a tension resisting horizontal bonding effect and also a vertical binding effect effective in one vertical direction, then according to a subsidiary feature of the invention it is preferred that the projections and withdrawn portions which engage behind each other and which are provided on the facing recesses and on the supplementing stones inserted therein respectively should be designed also to act as protuberances and recessed parts and be confined to a lower zone of the composite structure. In this manner, it becomes possible to provide a composite structure wherein the traction-resisting anchoring of adjacent laying units is invisible from the upper surface of the composite structure. Since the projections and withdrawn portions also assume the function of protuberances and recessed parts, the result is a comparatively simple mode of assembly of the laying units and of the supplementing stones.

If, then, the contour of the entire laying unit is already formed with protuberances and recessed parts it may be advantageous from the manufacturing aspect that also the contour of the recess should have protuberances and recessed parts. Correspondingly, there will then be formed in the periphery of the inserted supplementing stone only recessed parts, so as to permit insertion thereof. Then, there is no associated projection on the supplementing stone to engage into the recessed parts of the recess.

Moreover, numerous stone shapes are known which can be employed as supplementing stones, for example in accordance with German Auslegeschrift No. 1,708,675, having protuberances and recessed parts at the periphery. Correspondingly, there will then be formed at the contour of the recess only recessed parts so as to permit insertion of the supplementing stone. The recessed parts of the supplementing stone then do not engage over or under any corresponding protuberance of the recess.

Turning to the laying unit for the composite structure according to the invention, these may have recesses in only two opposite sides of the laying unit (at least one recess per side) for example if the laying units are laid in cross-bond pattern and the thrust forces are already taken up in the direction perpendicular thereto due to the kind of laying. However, it is advantageous to form the recesses on all sides of the laying unit. Thereby there is much less limitation as to the arrangement of the laying units in the composite structure, and a substantially more uniform toothed-engagement of the laying units with one another is provided.

For the sake of simpler design of the mold frame for manufacture of the laying units and also of uniform stressing or all the supplementing stones, it is preferred that all the recesses should have the same shape.

In the case of laying units of which the elements are identical, it is preferred that the recesses should each be equivalent in extent to a fraction of the surface area of one element, preferably as a whole-number fraction. It is especially advantageous if the recesses are equivalent in extent to one half of the surface area of an element, since then, after placing of the laying units adjacent one another and insertion of the supplementing stones, the resulting visual effect is that of a continuous uniform covering. Additionally, uniform distribution of the bonding (linking) forces is achieved, since the forces transmitted from the supplementing stones are passed on by the elements of the laying unit which in regard to order of magnitude are of like cross-section.

However, it is also possible to provide an arrangement in which the extent of each recess is equivalent to the surface area of at least one element. In this case, the bonding forces are transmitted by supplementing stones which are larger than the individual elements of the laying unit. However, in place of a relatively large supplementing stone, it is possible to employ a plurality of parallel-extending supplementing stones having the format of an element.

Preferably, in particular in the case of elements arranged in herringbone pattern, the recesses are arranged in mirror-image fashion at a pair of opposite sides of the laying unit. Neighbouring layer units can then be joined up without offsetting at this lateral pair, so that in the case of laying units which (save for the recesses) are rectangular, straight edges are formed at the edges of the laid face parallel to these sides. Advantageously, the recesses are also arranged at the other pair of opposite sides of the laying unit in mirror-image fashion relative to each other. Apart from the simpler mold assembly for the manufacture of the laying units, the risk is eliminated of placing a laying unit incorrectly rotated through 180°. In the case of laying units of substantially rectangular contour, it is moreover made possible to cover quadrangular surfaces without need for specially shaped edge units. It is, merely necessary to see that the recesses of the laying units located at the edge of the surface to be laid are completely filled with appropriate supplementing stones.

According to a particularly advantageous further development of the invention, the element of the pattern is centrally-symmetrical, of a shape equivalent to two adjoining squares, and having at its four sides protuberances and recessed parts which can be interengaged by parallel displacement of a pair of opposite sides. These elements may be arranged in herringbone pattern (if desired cohering by way of predetermined rupture zones), and they provide an especially strong and well subdivided horizontal bond of the elements relative to each other. The known stones having this shape may be used as supplementing stones subject to appropriate design of the recesses at the periphery of the laying units. Within the framework of the invention however the elements may have any other desired contour, for example rectangular or a contour determined by rectilinearly or curvilinear bounded protuberances and recessed parts.

The predetermined rupture zones by means of which the individual elements are held together to constitute a laying unit are contrived for example by means of open free dummy gaps formed by recessing the material. These dummy gaps may be provided on the upper side or the underside or on both the upper and undersides of the laying unit.

Additionally, in the following text the expression "dummy gap" is to be understood to mean not only an open free dummy jointing gap formed by recessing of material, but also a weakened portion of the material produced by the insertion of any desired type of material strip. Such material strips may completely interrupt the connection between the material of the laying unit adjacent their two sides, such as would be the case for example with inserted plastics strips, or they may permit a partial local bonding or cohesion of the material of the laying unit on the two sides of the inserted strip of material as would be the case with inserted net-like material webs or sheets. Such material webs or sheets may also extend throughout the entire height of the laying unit to provide the predetermined rupture zones.

A particularly preferred further development of the laying unit, wherein at least one predetermined rupture zone is contrived by dummy gaps provided on the upper and/or lower side of the laying unit involves the arrangement whereby along at least one dummy gap the height thereof varies.

Such a laying unit constitutes an advantageous further development of the laying units described above and is particularly suitable for composite structures embodying the invention. However, more generally speaking, it has its own inventive significance.

The height or level of the predetermined rupture zones in the laying unit must be carefully selected. If they are of relatively small height, then in particular in the case of laying units of relatively large format and upon lateral engagement of the laying units, for example engagement into recesses at the periphery thereof, there is a risk that the laying unit may rupture on being handled before having been laid or placed. If on the other hand, predetermined rupture zones of greater height are provided, then it has been found in many cases that the desired rupturing is difficult of achievement. This applies in particular to covering slabs wherein dummy gaps are provided on only one flat side.

It has been found that, in the case of the laying unit last mentioned, not only is reliable and problem-free separation or severing of the elements achieved along the predetermined rupture zones, but also a high degree of protection is obtained against un-intentional rupture during transport or on lifting by lifting means engaging at the sides. A special advantage of this laying unit resides in that the desired longitudinal profile of the dummy gap can be produced in simple manner by forming suitable projections on the shaped elements used for forming the dummy gaps of the laying unit, or by providing appropriately shaped strips of material for insertion.

The predetermined rupture zones may extend at right angles to the flat sides of the laying unit or at least part of them may be inclined relative thereto. Concrete is the preferred material.

In a laying unit wherein the height of a dummy gap varies along its length, the variation is preferably regular and/or discontinuous. Furthermore, a corrugated or serrated configuration of the bottom of the dummy gap is preferred.

Especially advantageous is a form of the laying unit in which the dummy gap has at least one section occupying the entire height of the laying unit, the desired rupture zone being subdivided into a plurality of individual desired rupture sections. Such a desired rupture zone in turn makes it possible to use a shaped element for insertion into the mold for producing the laying unit, which has the shape of a recessing plate and which is particularly stable and resistant to torsion, since such a recessing plate can extend right down to the bottom of the mold. In this way warping or flutter of the recessing plate is lessened.

Clearly if the dummy gaps are formed by insertion of shaped elements (for example recessed plates) into the mold the profile of the bottom of the dummy gaps must be such that the shaped elements can be withdrawn from the mold without destroying the profile which it is desired to produce. Generally, undercut portions with reference to the direction of movement of these shaped elements will be avoided. In some cases however specific undercut portions are advantageous; examples of this will be given hereinbelow.

Preferred embodiments of the laying unit, wherein the bottom of the dummy gaps is not undercut with regard to the direction of movement of shaped elements employed to form the dummy gaps may be ascertained from the detailed description below.

In particular for the purpose of achieving improved strength of the laying unit, for extracting the latter from the mold and during transport and when machine laying is employed (whereby for example the laying unit is gripped only at its sides), the laying unit can advantageously be further developed in such a way that an insert is provided in it extending at least from one element to an adjacent element transversely of the interposed predetermined rupture zone. In particular if the predetermined rupture zones are formed in the lower region of the laying unit, the provision of such an insert effectively improves the tensile resistance of the material of the laying unit precisely at these critical locations. Although the described advantages are particularly effective in association with the invention, nevertheless this further-developed laying unit is also of independent inventive significance.

The insert can upon rupturing or fissuring of the predetermined rupture zones in the laid laying unit, remain substantially undestroyed and in this manner afford a degree of cohesion of the elements of the laying unit which is effective in the horizontal and vertical directions. Such a degree of cohesion is also advantageous if it is required subsequently once again to take up a laying unit. The insert can however also be so designed that on rupture of the predetermined rupture zones it also ruptures at these locations.

Advantageously, the insert extends continuously through the entire laying unit. This mode of design facilitates manufacture of the laying units. Especially advantageous from the manufacturing aspect is an arrangement whereby the insert is provided parallel to the flat sides of the laying unit.

In a preferred embodiment of the laying units, the insert is in the nature of a flexible net-like three-dimensional structure. The net-like design ensures that the material of the laying unit can bridge through and across the insert; the flexible design of the three-dimensional structure favours problem-free rupture of the predetermined rupture zones.

According to a preferred, especially simple design of the laying unit, the insert is designed as a wide-mesh laid, plaited, braided, woven or knotted structure comprising elongated strands.

With regard to the material of the insert, it is preferred to employ a plastics, textile, glass fibre or wire insert, or combinations of these materials. The properties of the materials employed may be selected within wide limits, depending on the requirements of the object to be achieved. For example there may be employed rupturable, tearable, flexible, stretchable or resilient materials. In the case of laid structures of elongated strands, it is advantageous to employ a design in which parallel-extending first strands are intersected by second strands also extending parallel to each other.

Especially simple to manufacture and in certain fields of application imparting precisely the correct amount of strength is a further development of the laying unit wherein one of the inserts is made from elongated material particles distributed non-uniformly in a plane parallel to the flat sides of the laying unit. These material particles may be of non-uniform or uniform arrangement, or may also for example be concentrated in the laying unit at the locations of the predetermined rupture zones. As examples for such elongated material particles, mention may be made of wire sections or also pieces of rubber such as are produced on shredding old tires.

The manufacture of laying units wherein one or more predetermined rupture zones is contrived by means of dummy gaps provided on the upper and/or lower side of the laying unit can be carried out in a preferred mode whereby a first layer of a material for the laying unit is introduced into the mold, the insert is laid on to the first layer of the insert, the first layer and the insert are covered with a second layer of material and then the dummy gap or gaps is or are formed.

Alternatively, the mode of procedure may be such that the mold is first filled with material for the laying unit and then before this has set the insert is applied thereon and finally simultaneously with molding of the dummy gaps the insert is pressed into the material. If in this process shaped elements along component parts of their length press the dummy gaps right down to the underside of the laying unit and leave individual predetermined rupture sections standing between these component parts, the insert also is pressed-through in some of its parts right down to the underside of the laying unit, whereas in the predetermined rupture sections the insert bulges upwards whereby it is disposed in the right location for achieving the strengthening effect.

Just for such a laying unit having dummy gaps which occupy sectionwise the entire height of the laying unit, a preferred mode of manufacture is appropriate wherein the lateral marginal zones of the predetermined rupture sections in the mold are under engaged and the under engaged marginal zones are displaced on extracting the unit from the mold. Such under-engagement affords the advantage that even when a lower withdrawable plate is extracted from the manufacturing mold, the laying unit is retained in particularly effective manner until it is set down on a support or base on which it then sets. This manufacturing process can be seen in the finished laying unit in that the lateral flanks of the predetermined rupture sections are scored. Such lateral scoring may, additionally, also be advantageous for initiating the predetermined rupturing action.

A device for carrying into effect of the last-mentioned process, having a shaping element for forming dummy gap sections occupying the entire height of the laying unit and between which the predetermined rupture sections are arranged, is characterised in that the shaped element has under-engagement projections ending in a narrow edge extending in the direction of the predetermined rupture sections. The under-engagement projections may for example be shaped so that as seen in plan view they are of triangular cross-section providing a cutting edge facing the predetermined rupture zones.

The process for laying the laying unit to afford a composite structure is characterised in that the laying units are laid, with their recesses facing each other, on a prepared bed and then the supplementing stones are inserted into the facing recesses. Alternatively, the mode of procedure may be such that a laying unit is laid on a prepared bed, supplementing stones are inserted into all its recesses on one side and laying a second unit adjacent the side of the first so that the recesses on the adjacent side of the second unit engage the remainder of the supplementing stones, the procedure being repeated with fresh laying units and supplementing stones.

Due to the shape imparted to the laying units and the build-up of the composite structure from laying units and supplementing stones, the prerequisite is established for a process which further-develops the invention and which consists in that engagement is effected in each case with gripper means of a gripper device into the recesses formed in the laying unit and the latter is raised and set down on the bed adjacent the already laid laying units, with a small degree of jointing-gap spacing, and then the gripping means are once again withdrawn out of the recesses.

In this way the laying unit can be moved to the bed by the gripping means and there slowly deposited. If after the laying unit has been set down it is found that the bed has not been satisfactorily levelled and prepared, or if a laying unit has been wrongly laid, it can be raised once again without difficultly, to permit for example sand to be added or removed. Also on lifting part of the covering laid on a surface, such as is frequently necessary for example when laying or maintaining underground lines, the composite structure according to the invention affords substantial advantages relative to the prior art, due to the fact that the part of the surface covering requiring to be taken up can be lifted either mechanically or manually and can be re-laid in like manner. Thus, first the relatively light supplementing stones will be raised manually and extracted from the composite structure, and then, mechanically with the aid of gripping means of a gripper device, the heavy laying units may be raised. On lifting a composite structure devoid of supplementing stones, such a simple mode of operation is impossible.

The gripping means of the gripper device for the laying unit may be of hook-shape or claw-shape and may pass into abutment, with positive engagement, into and/or under the recesses formed in the laying unit. However, preferably the gripper means are brought into abutment for tight frictional engagement with the inner contour of the recesses, provided that the weight of the laying unit permits this to be done.

In order that the invention may be clearly understood and readily carried into effect several embodiments thereof will now be described by way of example with reference to the accompanying drawings, in which like or corresponding parts are designated by like reference numerals and in which:

FIG. 14 shows in plan a portion of a composite structure comprising substantially rectangular laying units subdivided by predetermined rupture zones into shaped stone elements arranged in herringbone fashion and at the longitudinal and transverse sides of which supplementing stones are inserted for connecting adjacent laying units with each other;

FIG. 15 is a cross-section through a jointing gap between two adjacent laying units taken along the line XV—XV of FIG. 14;

Figure 2:
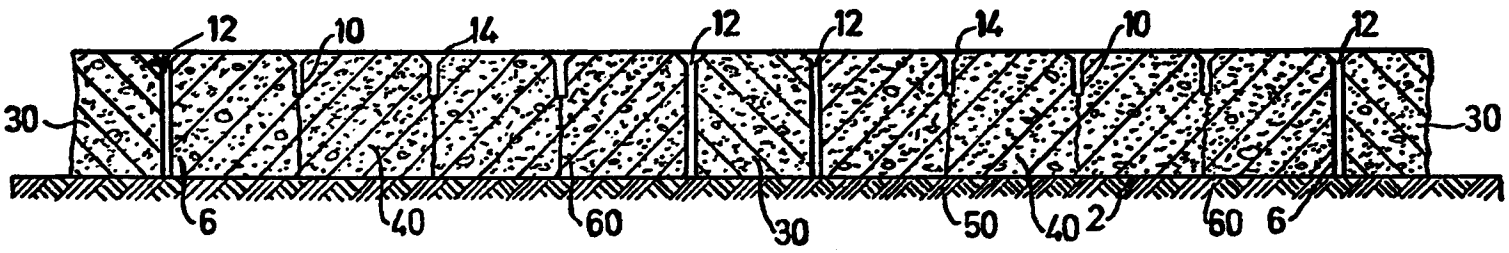
FIG. 2 shows the composite structure according to FIG. 1 in cross-section taken along the line II—II of that Figure.
Figure 1:
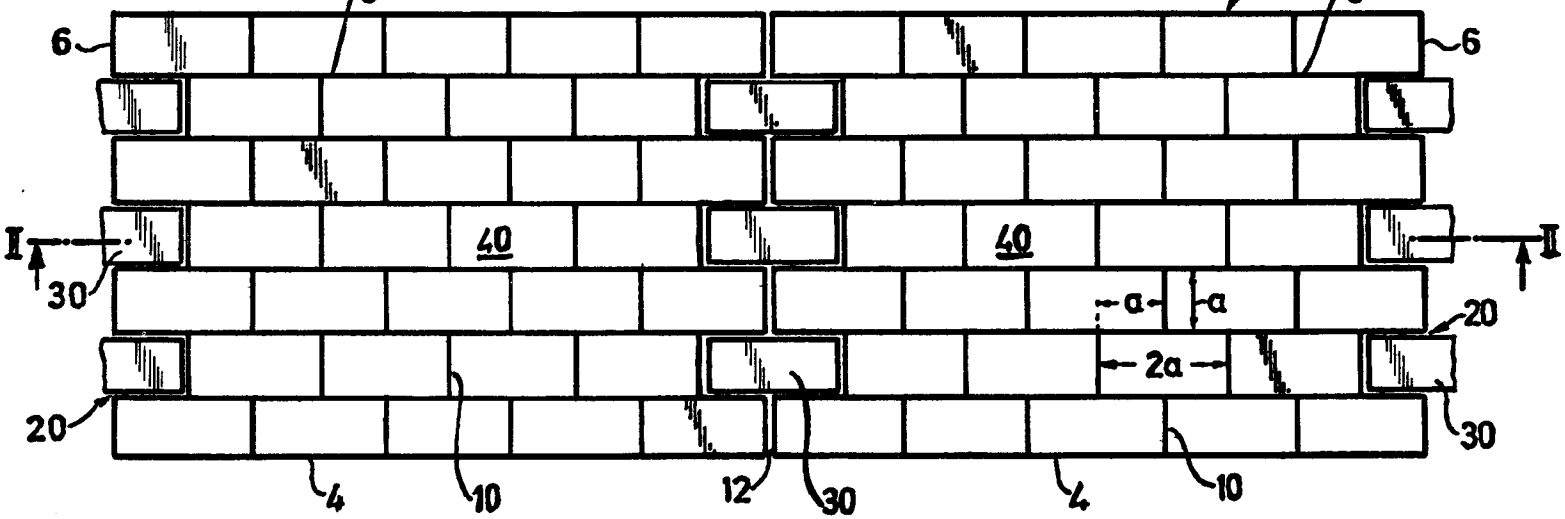
FIG. 1 shows in plan a portion of a composite paving structure having laying units provided with recesses at two opposite sides.

The composite structure shown in FIG. 1 is assembled from laying units 2 and supplementing stones 30. The laying units 2 have an elongated, substantially rectangular shape having rectilinear longitudinal edges 4. A network of simulated or dummy jointing gaps 8, 10 extends over the upper surface of each laying unit 2. The dummy jointing gaps 8 extend continuously parallel to the longitudinal edges 4 of the laying unit 2 and have regular spacing *a* relative to each other or relative to the longitudinal edges 4. The dummy jointing gaps 10 extend perpendicular to the dummy jointing gaps 8 and are so interrupted, at alternate rows constituted by the dummy jointing gaps 8 and, at the edge, by the longitudinal edges 4, that the dummy jointing gaps 10 are offset by the amount *a* from row to row in the longitudinal direction. The dummy jointing gaps 10 also have regular spacing *a* relative to each other. Owing to the network of dummy jointing gaps 8, 10 there is formed on the upper side of the laying unit 2 a pattern of rectangular elements 40 which are respectively of a length equal to 2*a* and of a width equal to *a*, and which constitute a pattern of so-called cross-bond composite structure. In the transverse direction, each laying unit is delimited by an edge 6 extending, at the corner of the laying unit 2, first of all for the length *a* at right angles to the longitudinal edge 4 of the laying unit 2 and then for the length *a* towards the interior of the laying unit 2, parallel to the longitudinal edge 4, then once again for the length *a* at right angles to the longitudinal edge 4, then for the length *a* in the outward direction away from the interior of the laying unit 2, parallel to the longitudinal edge 4 and then continuing repeatedly in this manner. The transverse edge 6 of the laying unit 2 thus precisely continues the pattern of the dummy jointing gaps 8,10 at the edge of the laying unit 2 and provides square recesses 20 of lateral length *a* and open towards the exterior of the laying unit.

The spacing of the recesses 20 or the spacing relative to the longitudinal edge 4 of the laying unit 2 again is *a* in each case.

The individual laying units 2 as seen in the longitudinal direction are separated from each other by a joining gap 12. Further laying units 2 follow in the transverse direction having corresponding jointing gaps 12. The recesses 20 are arranged symmetrically with respect to a transverse axis of the laying unit 2 and the individual laying units — without relative displacement in the transverse direction — are laid against each other, so that the longitudinal edges 4 of adjacent laying units 2 are in line. The recesses 20 formed in adjacent laying units 2 face each other; the gaps thereby formed in the composite structure are filled by rectangular supplementing stones 30 which connect the adjacent laying units 2 together in the transverse direction so as to resist thrust. Due to the dummy jointing gaps 8,10, the edges 4, 6 and the inserted supplementing stones 30, a continuous uniform cross-band pattern is formed on the surface of the composite structure.

The depth of the dummy jointing gaps 8,10 is approximately ⅓ of the thickness of the laying unit 2 and the remaining thickness constitutes in each case a predetermined rupture zone 60. Depending on the material of which the laying unit 2 is made, some other depth of the dummy jointing gaps 8, 10 and correspondingly of the predetermined rupture zones 60 may be more advantageous; it is merely necessary to ensure on the one hand that the laying unit 2 has sufficient strength for storage, transport and laying and on the other hand that the predetermined rupture zone 60 can be caused to rupture for example by jarring with a percussion device, or by stress due to traffic or thermal forces. The upper edges of the dummy jointing gaps 8,10 and also the peripheral edges 4,6 are finished with small chambers 14.

The composite structure is laid on a prepared and levelled base 50, consisting for example of sand. The jointing gaps 12 between adjacent laying units 2, and those between laying units 2 and the supplementing stones 30, are filled preferably from above with sand, for example with sand having a grain size ranging between 0 and 3.

The dummy jointing gaps 8,10 in the embodiment being described have a cross-section in the shape of a narrow open rectangle extending downwardly from the upper side of the laying unit 2. Instead of this however it would also be possible to provide dummy jointing gaps on the underside of the laying unit 2 or dummy jointing gaps both on the upper and on lower side which may additionally be laterally offset relative to each other to form inclined predetermined rupture zones 60 in the laying unit 2. For ease of manufacture of the laying units 2 it may be advantageous to make the lateral walls of the dummy jointing gaps 8,10 converge-slightly inwardly.

The laying units 2 may be made of any desired hardenable materials which meet the requirements in regard to suitability for molding cost and strength. Preferably they are made of concrete.

The size of the laying units 2 is approximately 1 $m^2$. They could of course be made smaller or larger. The larger the laying unit 2, the more economical is the laying of the composite structure; in the upward direction however the size of the laying unit 2 is limited by the dimensions of the production machine for manufacturing it and by the carrying capacity of the laying devices.

Figure 3:
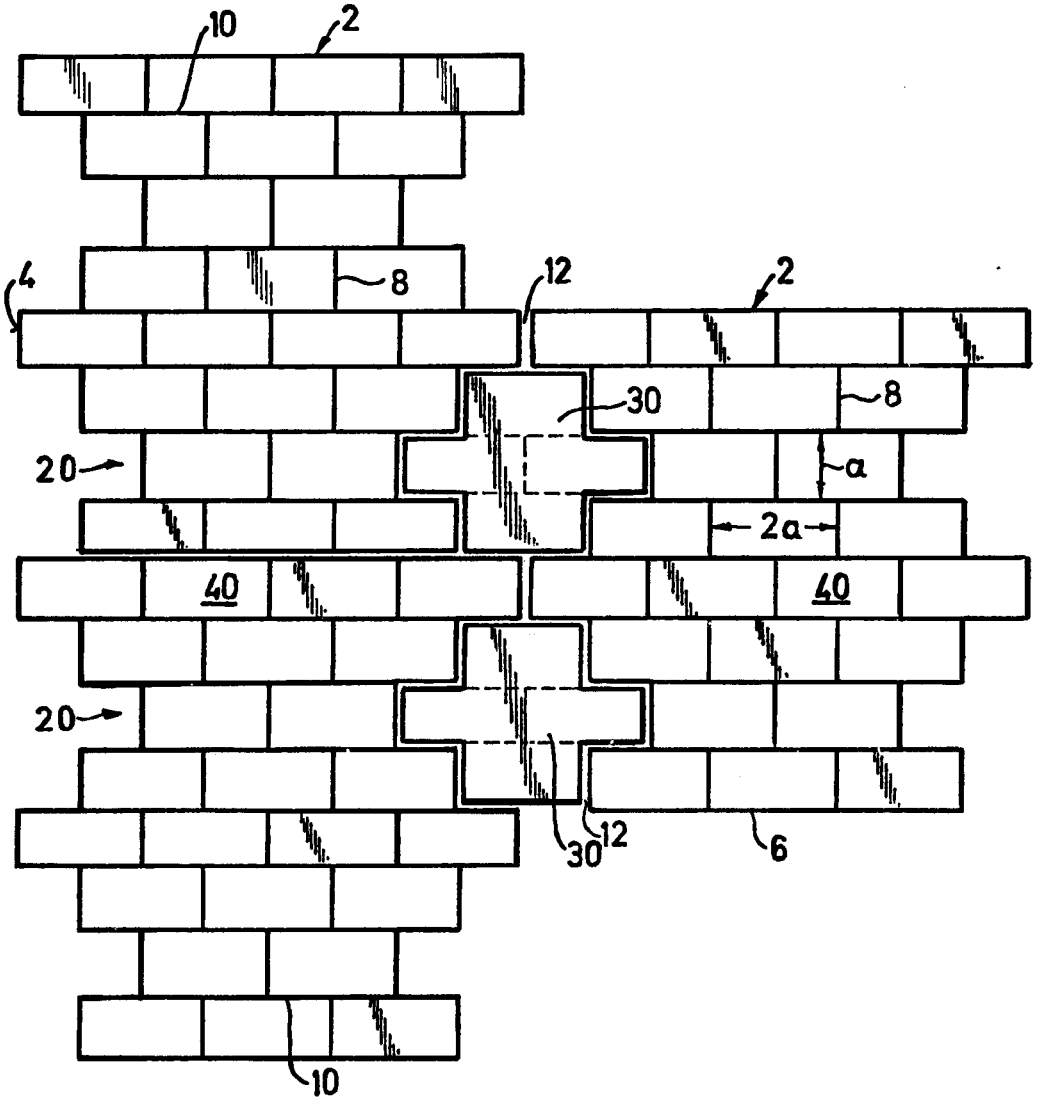
FIG. 3 is a plan view of a portion of a composite structure wherein the laying units are formed with recesses at opposite sides and are laid as a cross-bond structure.

The further embodiment of a composite structure shown in FIG. 3 comprises laying units 2 of square shape (disregarding the recesses) and wherein two recesses 20 are formed at each of the longitudinal sides. The laying units 2 are subdivided by dummy jointing gaps 8 in the longitudinal direction and by dummy jointing gaps 10 in the transverse direction, into elements 40 which as described in detail with reference to FIG. 1 constitute a cross-bond pattern and are attached together through the agency of predetermined rupture zones 60. The rectangular elements 40 are arranged in this embodiment with their longer dimensions extending in the transverse direction of the laying unit 2.

The recesses 20 are T-shaped, the cross bar of the T (as it were) constituting the open side of the recess. The recesses 20 are designed to form part of the cross-bond pattern of the dummy jointing gaps 8,10 and occupy the surface area of two elements 40.

The individual laying units 2 are arranged offset relative to each other by a half-length; in other words, they are also laid in cross-bond pattern. The supplementing stones 30 inserted into the recesses 20 which face each other at the longitudinal sides 4 of the laying units 2 without being offset form a horizontal composite bond in the longitudinal direction of the laying units 2, whereas a horizontal composite bond is provided in the transverse direction of the laying units 2 due to the mutual offsetting of the laying units 2.

The supplementing stones 30 have the shape of a cross of length 4*a* and width 3*a*. They may additionally (as indicated by broken lines) be subdivided by shallow dummy jointing gaps to provide a visual impression corresponding to the shape of the elements 40 or they may also be pre-notched to such an extent by means of adequately deep dummy jointing gaps that they rupture along the predetermined rupture zones provided thereby, like the laying units 2. In this manner the pattern of the elements 40 may be continued over the entire composite structure also in cases where the supplementing stones 30 are of an area equal to that of a plurality of elements 40. Of course, instead of the cruciform supplementing stones 30, it will be possible also to employ four supplementing stones each of the size of the elements 40.

Figure 4:
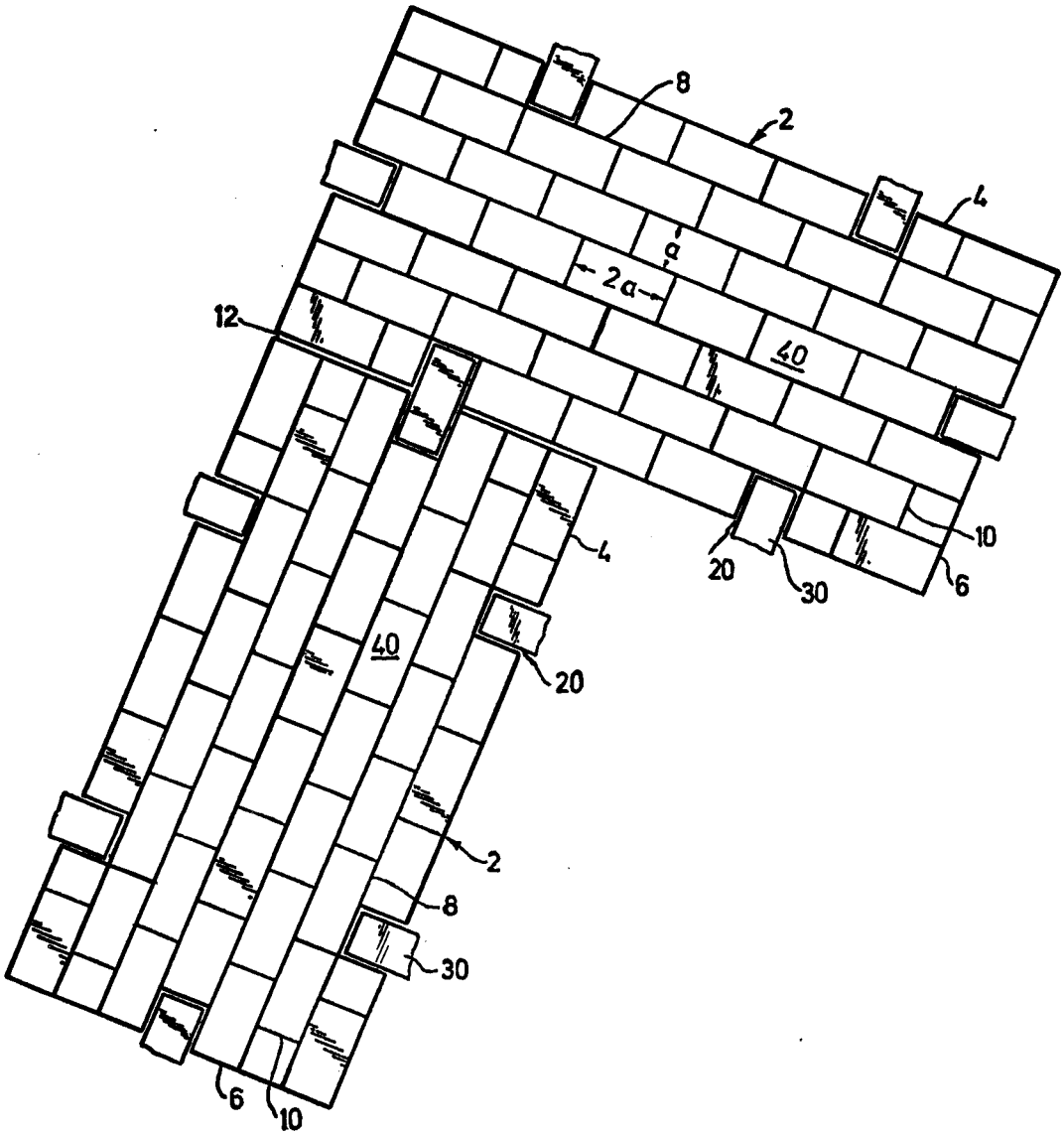
FIG. 4 shows in plan view a portion of a composite structure wherein the laying units have recesses in all sides of their periphery and are laid as a herringbone bond.

In the case of the embodiment of a composite structure as shown in FIG. 4, laying units 2 of substantially rectangular shape are provided of which the length is twice the width. As in the embodiment according to FIG. 1, the laying unit 2 is subdivided by dummy jointing gaps 8 in the longitudinal direction and dummy jointing gaps 10 in the transverse direction into rectangular elements 40 of length 2*a* and width *a* attached to each other by predetermined rupture zones 60. In the center of the transverse sides 6, each laying unit 2 has a recess 20, and the longitudinal sides 4 each have two recesses 20 respectively arranged in the center of each longitudinal side half. Whereas the recesses 20 at the transverse sides of the laying unit 2 are produced by omitting the half elements 40 which otherwise would be present as part of the cross-bond pattern, resulting in square recesses of a lateral length *a*, in order to form the recesses 20 at the longitudinal sides 4 of the laying unit 2, the uniform cross-bond pattern is slightly varied, inasmuch as one half has been omitted of the rectangular elements 40 of the cross-bond pattern.

In this embodiment the laying units 2 are laid as a herringbone composite structure and abut along jointing gaps 12. In addition to the bonding effect resulting from the herringbone mode of laying the laying units 2, the inserted supplementing stones 30 provide a well sub-divided bonding effect preventing relative displacement of the laying units 2 along the jointing gaps 12.

Figure 5:
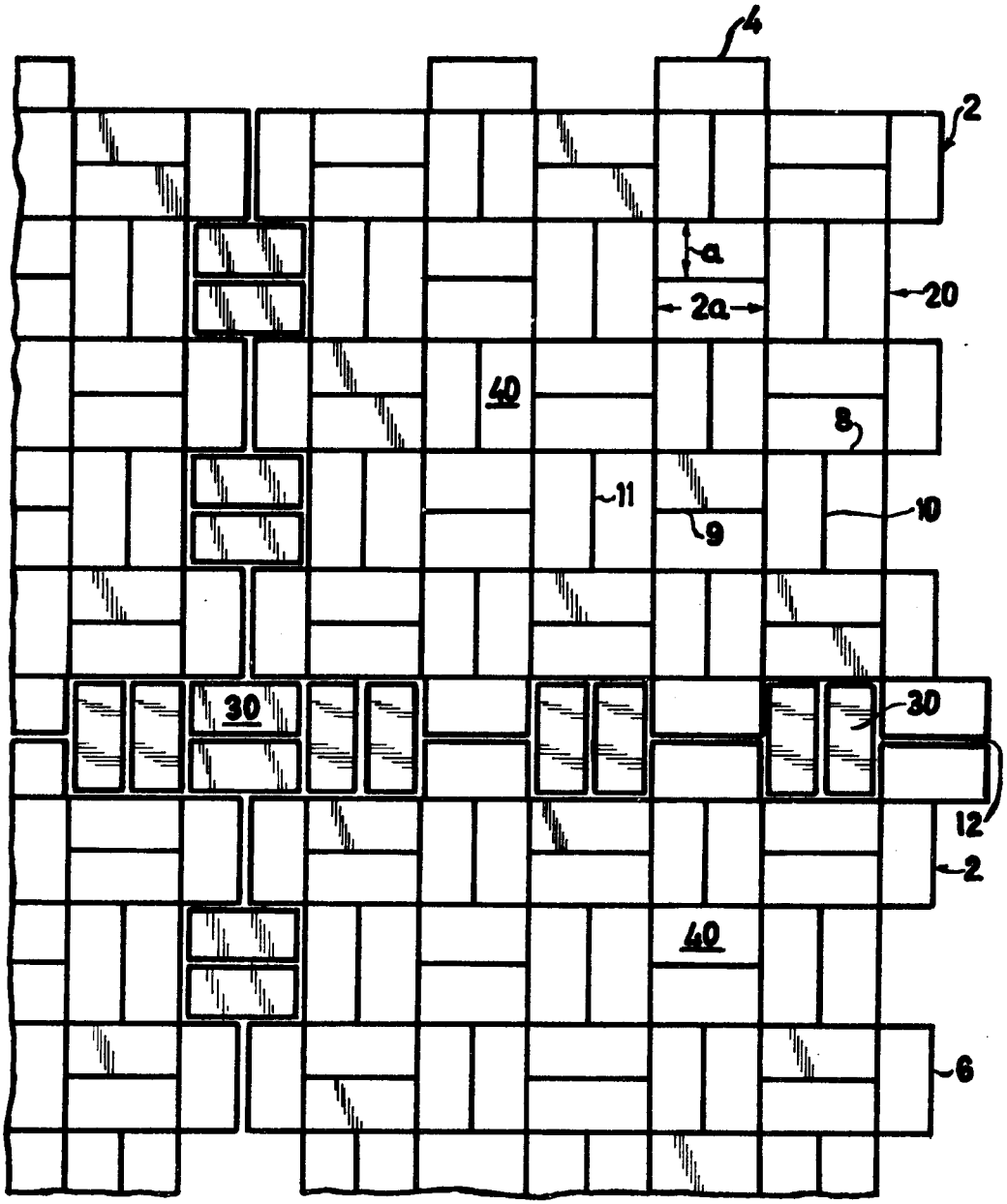
FIG. 5 shows a plan view of a portion of a composite structure wherein the laying units each have recesses along their entire periphery and are subdivided by predetermined rupture zones into element arranged in parquet pattern.

FIG. 5 shows a further embodiment of a composite structure of substantially square contour, i.e. disregarding the recesses 20 at the periphery of the laying units 2. Dummy jointing gaps 8 and 10 disposed parallel to this imaginary square contour extend throughout the upper side of the laying unit 2. The dummy jointing gaps 8 and 10 are spaced from each other or from the base of the recesses 20 by a distance 2*a* thereby forming a square checkerboard pattern on the upper side of the laying unit 2. Each of these squares is then subdivided, either by further dummy jointing gaps 9 extending parallel to the dummy jointing gaps 8 or by further dummy jointing gaps 11 extending parallel to the dummy jointing gaps 10, into two rectanglar elements 40, so that neighbouring squares are subdivided in different directions.

The edges 4 and 6 of the periphery of the laying units 2 have rectangular recesses 20 of length 2*a* and width *a* of which the length extends in the main direction of the particular edge 4 or 6 and can be regarded as providing for the continuation of the pattern by addition of further elements 40 in the longitudinal direction of the particular edge 4 or 6 to the above-described checker board pattern. In this way the upper side of the laying unit 2 is subdivided by a network of dummy jointing gaps 8,10 in so-called parquet pattern, and the recesses 20 are in each particular instance continuations of the parquet pattern with omitted elements 40.

Adjacent laying units 20 are so disposed in side-byside relationship spaced apart by the jointing gap 12 that corresponding recesses face each other without any offsetting.

At the corners of the laying units 2 (as shown on the left-hand side in FIG. 5) larger recesses having length 3*a* and width *a* are formed by superpositioning the recesses of two edges. Whereas only two rectangular supplementing stones 30 having the shape of the elements 40 are inserted into the recesses 20 in the central zone of the edges 4,6, at the corners it is necessary to insert six supplementing stones 30. It will be appreciated that the pattern of the elements 40 is completely continuous over the entire composite structure due to the supplementing stones 30. However, it is also possible, instead of supplementing stones 30 having the size of the elements 40, to insert correspondingly larger supplementing stones, for example square ones of edge length 2*a*, into the facing recesses 20.

FIG. 5 on the right-hand side shows how by appropriate design of the laying unit 2 and using a further element 40, the formation of larger corner recesses can be avoided.

The hitherto-described embodiments all relate to rectangular elements 40 having a length 2*a* and a width *a*. It is obvious that the elements could have other length/width ratios.

Figure 6:
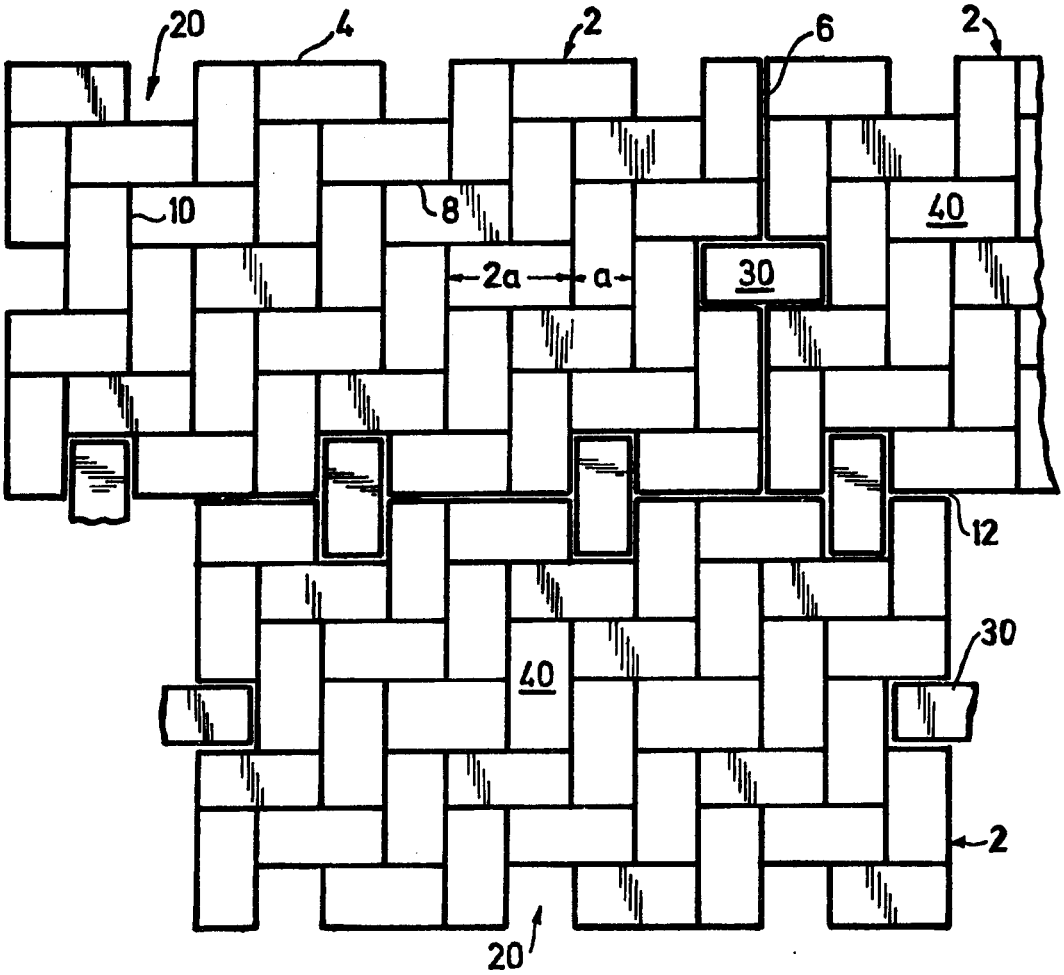
FIG. 6 is a plan view of a portion of a composite structure wherein the laying units each have recesses in their entire periphery and are laid offset relative to each other.

In the case of the embodiment shown in FIG. 6, each laying unit 2 of the composite structure is made up from rectangular elements 40 arranged in herringbone pattern of length 2*a* and width *a* joined together-by predetermined rupture zones 60 constituted by dummy jointing gaps 8 and 10. The contour of the laying unit 2 can be thought of as having been brought into being by cutting from a large-area herringbone pattern a rectangle having a length of twelve element widths and a width of seven element widths and that then the elements cut-through at the periphery of the rectangle are extracted from the laying unit 2 in order to form the recesses 20. The portion of the herringbone pattern is to be so cut out that there is formed in each case at the edges 6 in the transverse direction of the laying unit a recess in the center of the edge 6. Then there are formed in each instance at the outer longitudinal edges 4 of the laying unit 2 three recesses 20 offset relative to each other at opposite longitudinal edges 4 of the laying unit 2 by the value of one element width. Placed adjoining a laying unit 2 in the longitudinal direction along jointing gaps 12 are further laying units (without lateral off-setting), whereas in the transverse direction relative to the laying unit 2 the adjacent laying unit 2 is placed laterally offset by the value of three element widths in order that the recesses 20 formed in the adjacent laying units 2 may be disposed opposite each other. The recesses 20 facing each other are again filled with supplementing stones 30 of element size so that the composite structure seen as a whole exhibits a continuous and uniform herringbone pattern.

The laying unit 2 may also be employed in larger format, for example of double width, so that a plurality of recesses is formed also in the transverse edge 6.

Figure 7:
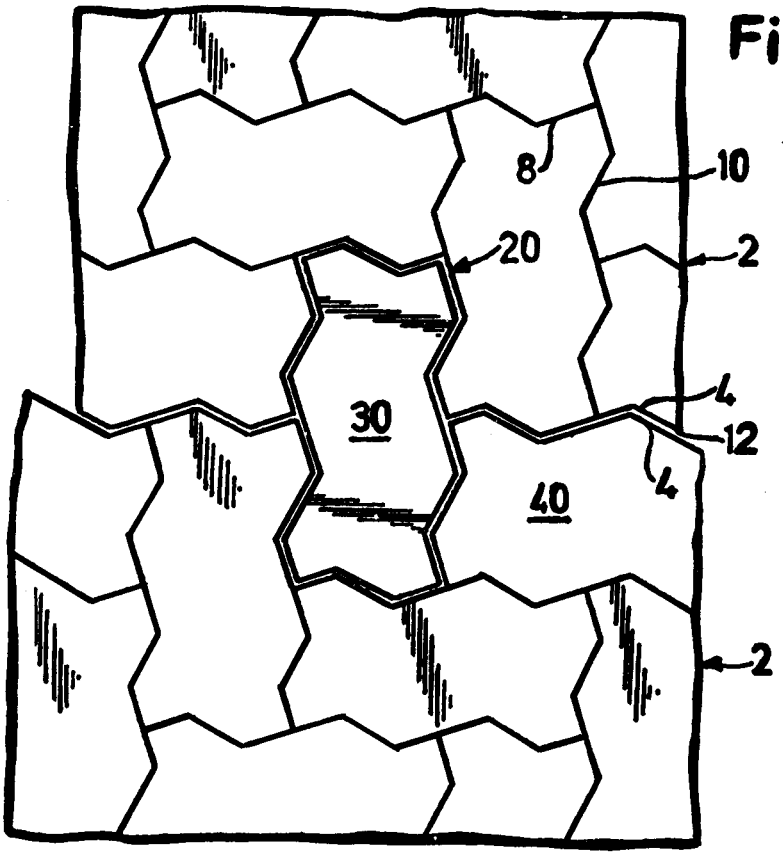
FIG. 7 shows in plan a portion of a composite structure similar to that according to FIG. 6, having an alternative form of the predetermined rupture zones and supplementing stones.
Figure 8:
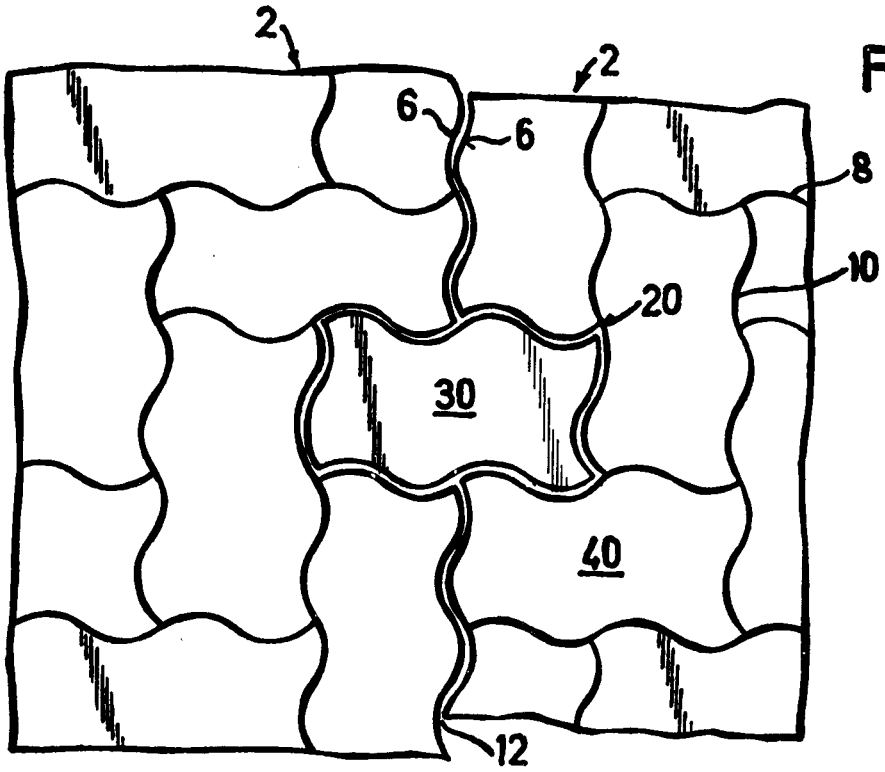
FIG. 8 shows in plan a portion of a composite structure also similar to that according to FIG. 6, with an alternative design of the predetermined rupture zones and supplementing stones.

In the case of all the embodiments hitherto described, the individual elements 40 of the laying unit 2 and also the connecting stones 30 are all of rectangular shape. Additional advantages however follow from a design of the contours of the recesses 20, corresponding to the supplementing stones 30, with projections and withdrawn portions since thereby it becomes possible to achieve traction-resisting engagement of adjacent laying units. The shape of the recesses and of the supplementing stones may, furthermore, be repeated in the shape of the individual elements 40. These projections and withdrawn portions may be provided by plane or curved delimiting spaces in periodic, axis-symmetrical or central-symmetrical arrangement, or in any other desired arrangement. FIGS. 7 and 8 show by way of example two embodiments taken from the large possible number of variations, as a portion of the laying units 2 according to FIG. 6.

In the case of the embodiment shown in FIG. 7, the elements 40 have a shape predetermined by the dummy jointing gaps 8 and 10 of zig-zag outline. The recesses 20 and the supplementing stones 30 also have the same shape. Elements formed with projections and withdrawn portions provide particularly good horizontal bonding of the elements 40 to each other.

The contour of the elements 40, the recesses 20 and the supplementing stones 30, in the case of the embodiment shown in FIG. 8, is in the form of sinusoidal lines which replace the rectilinear lateral delimitations according to FIG. 6. Also in the case of this embodiment a traction-resisting connection of the two adjacent laying units 2 is achieved and especially effective horizontal bonding of the elements 40 to each other.

Figure 9:
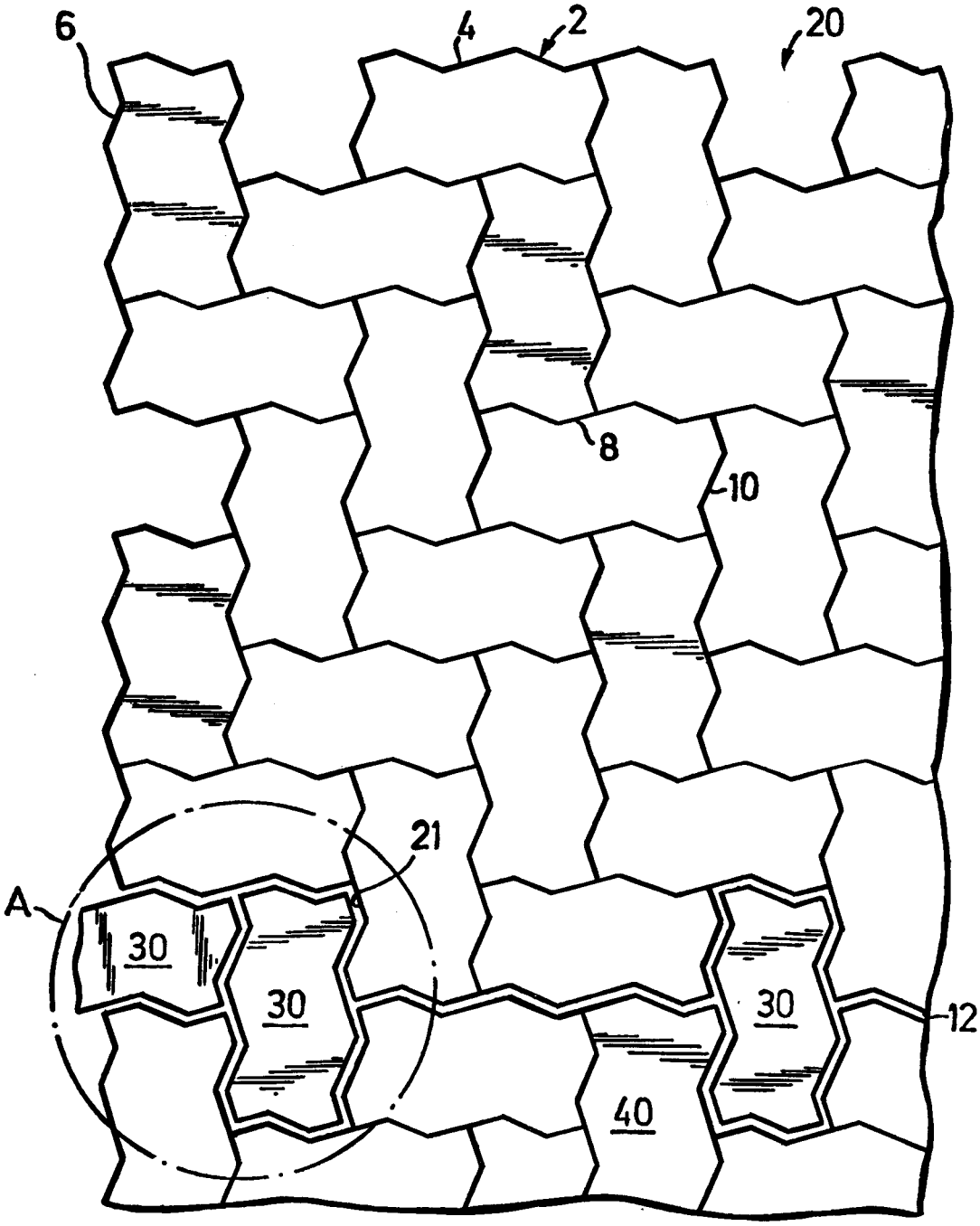
FIG. 9 shows a plan view of a portion of a composite structure wherein the laying unit is formed along its entire periphery with recesses which, with respect to two axes, are arranged in mirror-image fashion relative to each other.

The composite structure of the embodiment shown in FIG. 9 may be thought of as having been derived from the laying unit 2 shown in FIG. 6 by adding to its longitudinal side a further row of elements 40 of like width as an element width. The shape of the elements 40, the recesses 20 and the supplementing stones 30 corresponds to the embodiment shown in FIG. 7.

In addition to the opposite lateral edges 6 of the laying unit 2, in the case of this embodiment the opposite lateral edges 4 of the laying unit are also designed to be mirror-images of each other. The composite structure now consists of laying units 2 which are not offset relative to each other in any direction and of connecting stones 30 inserted into recesses 20 located opposite each other (as shown). However also with this shape of laying units 2 it is possible to provide a composite structure having laying units 2 that are laterally offset relative to each other in the longitudinal direction.

With this embodiment of the composite structure, however, there is formed at a corner A of each laying unit 2 a specially shaped recess 21 which is twice the size of the other recesses 20 of the relevant laying unit 2 and in each particular instance is equivalent to two half supplementing stones 30 in extent. However, this does not produce any disadvantage for the composite structure; but it will be expedient to ensure that on stacking the laying unit 2 on edge the edge A is positioned uppermost.

Whereas in the case of the embodiments hitherto described the supplementing stones contribute to the horizontal bonding effect of the laying units relative to each other, there will now be described embodiments in which the supplementing stones and the recesses have vertical bonding faces effective in one direction.

Figure 11:
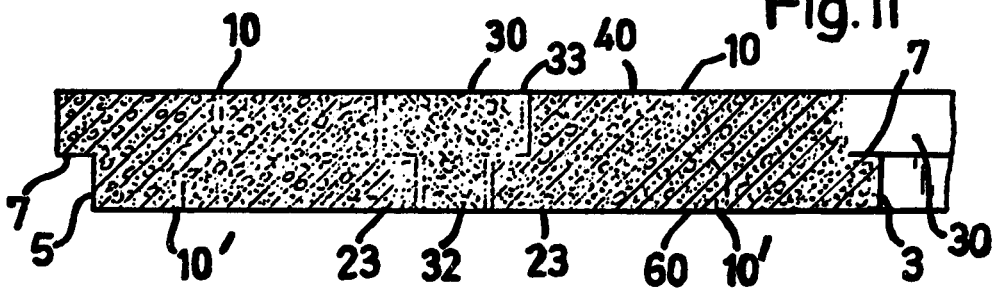
FIG. 11 is a cross-section through a laying unit taken along a line XI—XI of FIG. 10.
Figure 10:
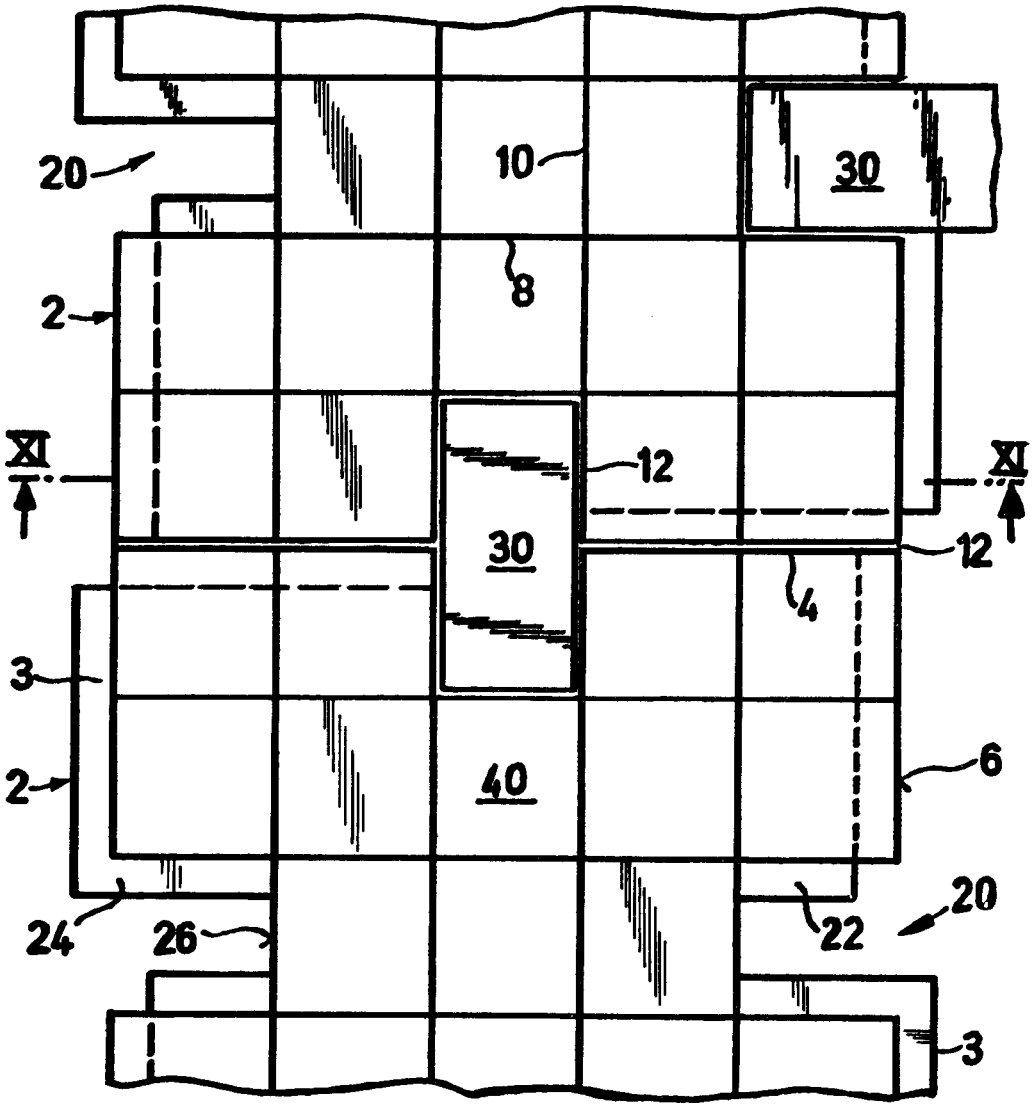
FIG. 10 is a plan view of a portion of a composite structure of substantially square laying units into each of which a supplementing stone is inserted at all four sides for connecting adjacent laying units with each other.

In the case of the embodiment shown in FIGS. 10 and 11, the contours of the laying units 2 of the composite structure have been produced from a square contour. Each laying unit 2 is sub-divided by first dummy jointing gaps 8, 10 on the upper side of the laying unit 2 into 21 elements 40 which are squares as seen in plan. The said shaped stone elements are joined together via predetermined rupture zones 60 extending obliquely relative to the upper side of the laying unit 2, the predetermined rupture zone 60 being formed by the first dummy jointing gaps 8, 10 designed in the form of open recesses on the upper side of the laying unit 2 and by second dummy jointing gaps 8',10', again having the shape of open recesses, arranged on the underside of the laying unit 2 with lateral spacing from the first dummy jointing gaps 8,10. The first dummy jointing gaps 8,10 and the second dummy jointing gaps 8',10' each extend parallel to the edges 4, 6 of the laying unit 2 which basically form a square.

In the center of each side of the laying unit 2, there is arranged, instead of an element 40, a recess 20 having in its upper half a contour 26 in the shape of an open sided square.

Each laying unit 2 is provided at its periphery with protuberances 3 and recessed parts 5. The protuberances 3 have the shape of a protruding step half the height of the laying unit, the length thereof being that of two element lengths. They each extend from a recess 20 towards the right to a location a short distance before the corner of the particular laying unit 2; proceeding from the recesses 20 towards the left, the recessed parts 5 extend in the form of a withdrawn step again having half the height of the laying unit 2. At the inner contour 26 of the recesses 20, there are again protuberances 22 and 24 which, in the case of this embodiment, occupy half the height of the laying unit 2. With this arrangement, the protuberances 24 are each arranged at that side of the recess 20 which is adjacent the protuberance 3 at the contour 4 of the laying unit 2. The protuberances 24 are of such a length that they merge into the recesses at 26. The protuberances 22 at the opposite side of the recess 20 are somewhat shorter than would correspond to the recess, so that the particular recessed part 5 at the contour of the laying unit 2 continues undisturbed as far as the recess 20. The protuberances or recessed parts 3, 5, 22 and 24 are delimited at their upper side in each instance by horizontal faces 7 and 23. It should be specially emphasized that these spaces may also be so designed that they are inclined relative to the horizontal, preferably being inclined relative to the center of the recess 20.

The individual laying units 2 are so laid that the recesses 20 of adjacent laying units 2 face each other. With this arrangement there remains in the horizontal direction, between the individual laying units 2 a jointing gap 12 for taking up thermal expansion of the composite structure which may for example be filled with sand or poured with bitumen. Inserted from above into the facing recesses 20 of adjacent laying units 2 are supplementing stones 30 which are rectangular as seen in plan view. The supplementing stones 30 are of two-zone construction, the lower zone corresponding to the recessed part 32 having half the height of the supplementing stone, extending in the longitudinal direction of the supplementing stones 30. The transition portion from the lower zone to the upper zone of the supplementing stone 30 is constituted by horizontal faces 33.

On placing the laying units 2 one against the other, the protuberances 3 engage into the particular opposite recessed parts 5, thereby achieving a vertical bonding effect of the laying units 2 relative to each other. At the location of the inserted supplementing stones 3 a horizontal bonding effect is produced between the laying units 2 and, additionally, a vertical bonding effect which is effective in one direction. The horizontal faces 7, 23 and 33 for vertical engagement may also be formed as inclined faces. Additionally, if vertical tolerances are provided for, jointing gaps (filled for example with sand) can be provided in the vertical direction at these engagement faces.

Figure 13:
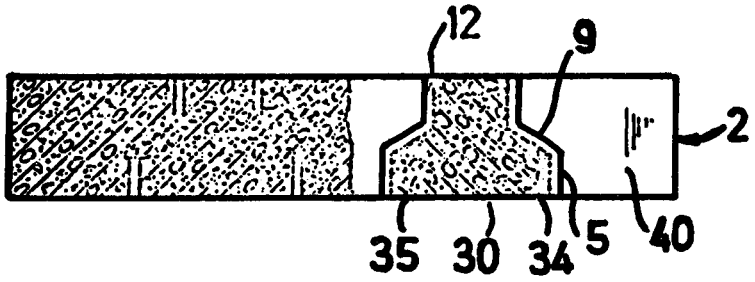
FIG. 13 is a cross-section partly through a jointing gap between two adjacent laying units taken along the line XIII—XIII of FIG. 12.
Figure 12:
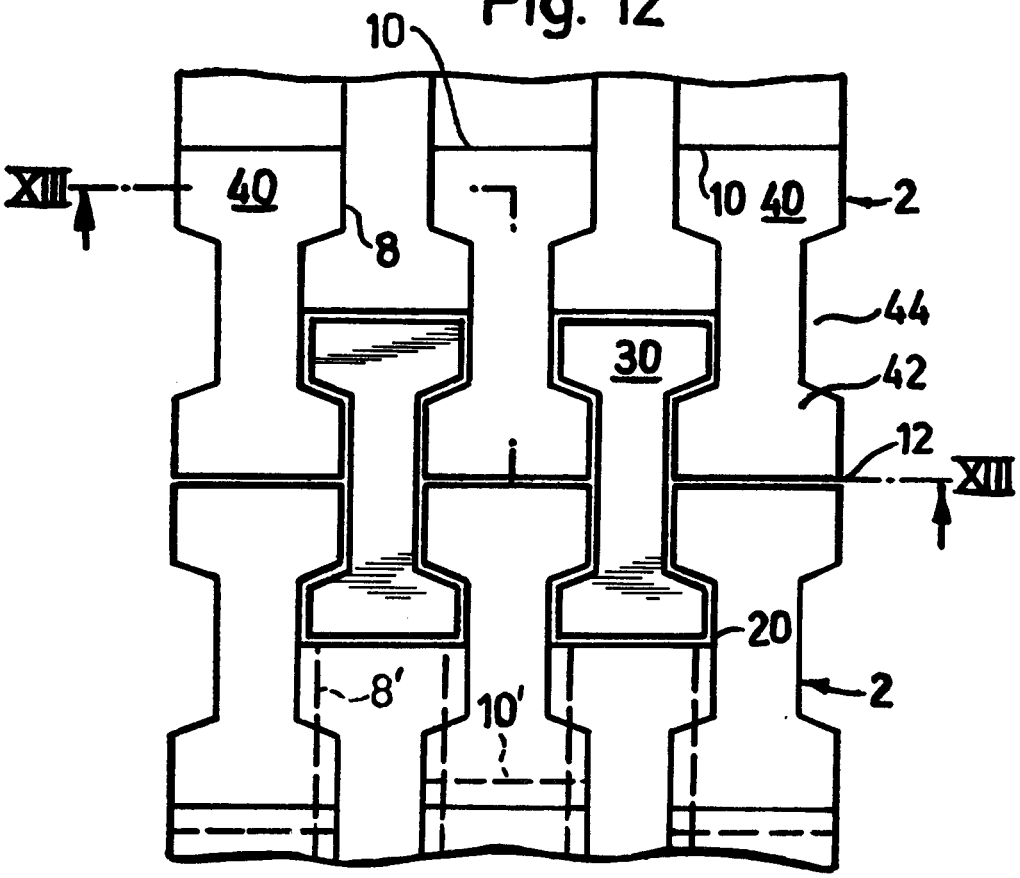
FIG. 12 shows a plan view of a portion of a composite structure of substantially rectangular laying units, in the transverse sides of each of which supplementing stones are inserted for connecting adjacent laying units with each other.

The composite structure of which a portion is shown in FIGS. 12 and 13 has laying units 2 of substantially rectangular shape. These are sub-divided by first dummy jointing gaps 8,10 on the upper side of the laying unit 2 into elements 40 which as seen in plan view are double-T-shaped. The surfaceshape, defined by the first dummy-jointing gaps 8,10 of the shaped stone elements 40 is known per se. It is produced if, in the case of a rectangular shaped stone, there are formed recesses 44 of which the inner delimitation extends parallel to the original longitudinal sides of the stone and the lateral delimitations extend outwardly in chamfered manner. In this way a recess 44 is produced having the shape of an open trapezium and into which the head-piece 42, not associated with the recesses, of two adjacent shaped stones can be partially inserted. Shaped stones of such configuration can therefore be laid one against the other, longitudinally and offset by half a stone length in each case.

The individual elements 40 of each laying unit 2 are jointed together via predetermined rupture zones 60 extending inclined with respect to the upper side of the laying unit 2. To form such predetermined rupture zones 60, there are provided in addition to the first dummy jointing gaps 8,10, second dummy jointing gaps 8', 10' on the underside of the laying unit 2 as indicated in FIG. 12 by broken lines. The second dummy jointing gaps 8' are arranged, over the greater portion of their length, with lateral spacing relative to the first dummy jointing gaps 8, this being especially simply achieved in the longitudinal direction of the laying unit 2 by rectilinear second dummy jointing gaps 8' extending respectively alternately to one side and to the other side of the first dummy jointing gaps 8. In the transverse direction of the laying unit 2, for example, the second dummy jointing gaps 10' are arranged alternately to one side and to the other side of the first dummy jointing gaps 10.

At each transverse side of the laying unit 2, every alternate half element 40 is omitted to form recesses 20. The headpieces 42 of the elements 40 which have been left are in each case provided with recessed parts 5 located underneath, whereas in the case of the supplementing stones there are arranged, in the zone of the recesses 40, protuberances 34 located underneath, so that the full rectangular format is restored in an underlayer of the supplementing stone 30. The recessed parts 5 and the protuberances 34 are connected, through the agency of obliquely-extending vertical engagement faces 9 and 35, to the particular contours visible from the upper side. The supplementing stones 30 are in each case inserted from below into two facing recesses 20 of the adjacent laying units 2. On laying the composite structure, first of all with the laying unit 2 in a raised position the supplementing stones 30 are inserted from below, as to one half in each case, into a recess 20, and then the laying unit 2 is set down on the prepared bed. On placing the next adjacent laying unit 2, further supplementing stones 30 merely require to be inserted from below at one transverse side of the laying unit 2, whereas the recesses 20 at the other transverse side of the laying unit are slid-on from above over the supplementing stones 30 already laid with the adjacent laying unit 2. There are jointing gaps 12 between adjacent laying units 2, and between the laying units and the inserted supplementing stones 30.

Also at the longitudinal sides of the laying units 2, provision may be made for vertical bonding effect between adjacent laying units 2. For example, the recesses 44 formed in the elements 40 located at the edge may be provided in a manner similar to that employed with the supplementing stones 30, with protuberances 34 occupying a portion of the height of the recess 44. Corresponding recessed parts in a lower zone of the head-pieces 42 of the adjacent layer unit 2 may engage over the projections 32 at this location. By means of flat webs or lands half-way up the recess 44 and corresponding slots in the head-pieces 42, it is also possible to achieve a vertical engagement effective in two directions between adjacent laying units 2.

Figure 16:
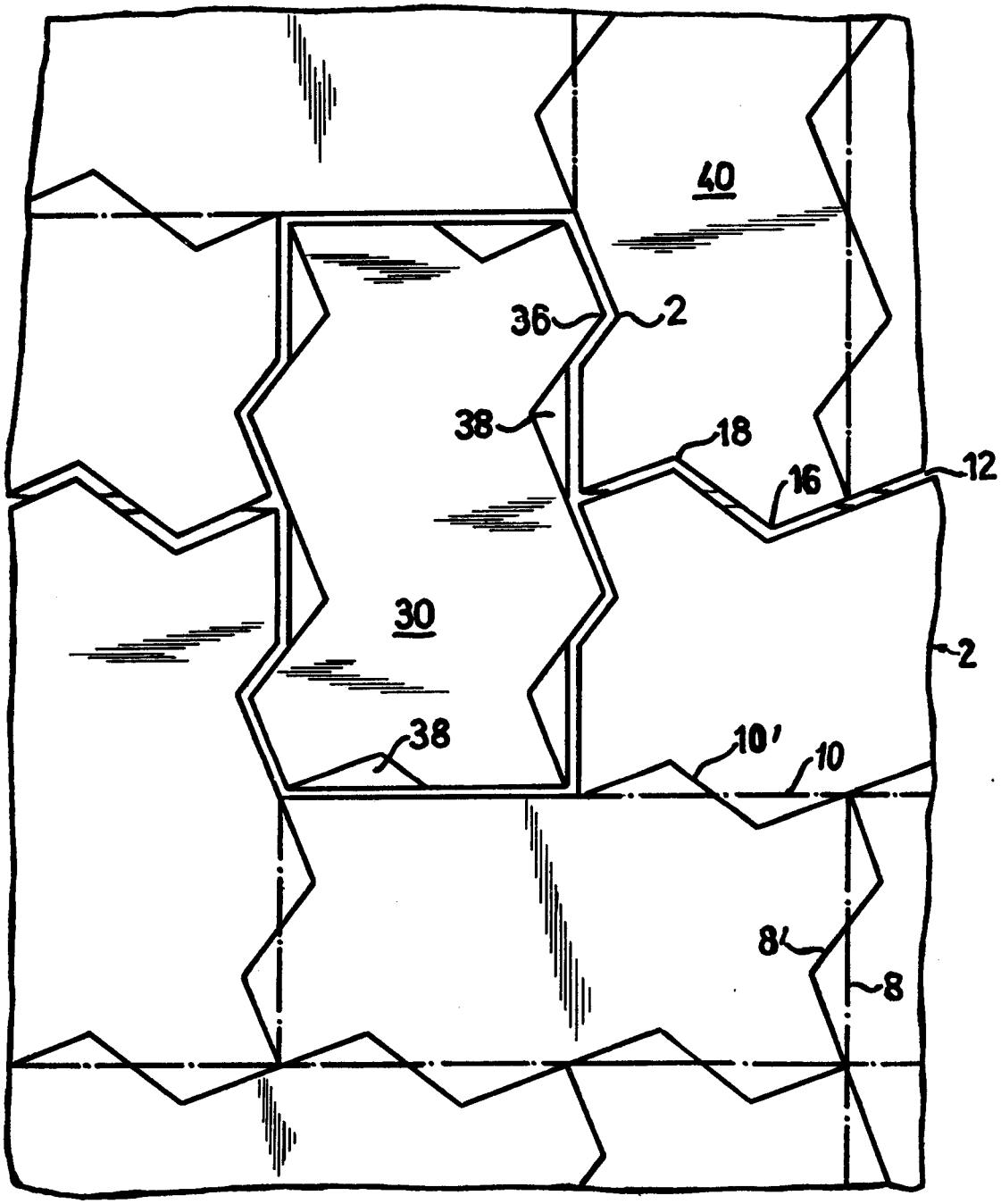
FIG. 16 shows an underneath plan view of a portion of the composite structure according to FIG. 14 in the region where a supplementing stone is inserted into two adjacent laying units, the illustration being drawn to a larger scale.

The composite structure of which part is shown in FIGS. 14, 15 and 16 has laying units 2 of substantially rectangular shape. The upper side of each laying unit 2 is divided, by first dummy jointing gaps, into a pattern of rectangular elements 40 arranged in the manner of a herringbone bonded pattern.

The second dummy jointing gaps 8', 10' associated with the first dummy jointing gaps 8, 10 for providing inclined predetermined rupture zones 60, on the underside of the laying unit 2, are zig-zag shaped, the teeth on both sides of the associated first dummy jointing gap 8', 10' projecting for an equal distance, as indicated by broken lines in a corner of FIG. 14.

Each laying unit 2 has the length of eight element widths and the width of seven element widths. At all locations where, in the case of a corresponding rectangular portion cut from a herringbone bond pattern elements 40 would be intersected, square recesses 20 are formed by omitting appropriate element halves. Along the entire outer periphery of each laying unit 2, saw-tooth-like protuberances of projections 16 and recessed parts or withdrawn portions 18 are provided in a lower zone of the laying unit 2. The transition to the vertical contour faces 19 of the upper layer is provided by inclined toothed-engagement faces 15.

As shown in the drawing at two facing recesses 20, the contour of the recesses 20 is also in each case provided with two recessed parts 28 serving simultaneously as withdrawn portions and having the shape of the recessed parts 18. It follows from the fact that these recessed parts 28 are also formed only in a lower zone of the laying unit 2 that the supplementing stones 30 can, during laying, be inserted, only from below into two facing recesses of adjacent laying units 2. A corresponding insertion method during laying has already been described above.

As supplementing stone 30 a rectangular stone is used having at its longitudinal sides, in a lower zone, protuberances or projections 36 and also recessed parts or withdrawn portions 38, and at its transverse side only recessed parts or withdrawn portions 38. The shape of these protuberances 36 and recessed parts 38 corresponds again to the shape of the protuberances 16 and the recessed parts 18 at the periphery of the laying unit 2. The recessed parts 38 in this arrangement are devoid of any function in respect of the bonding effect.

Figure 17:
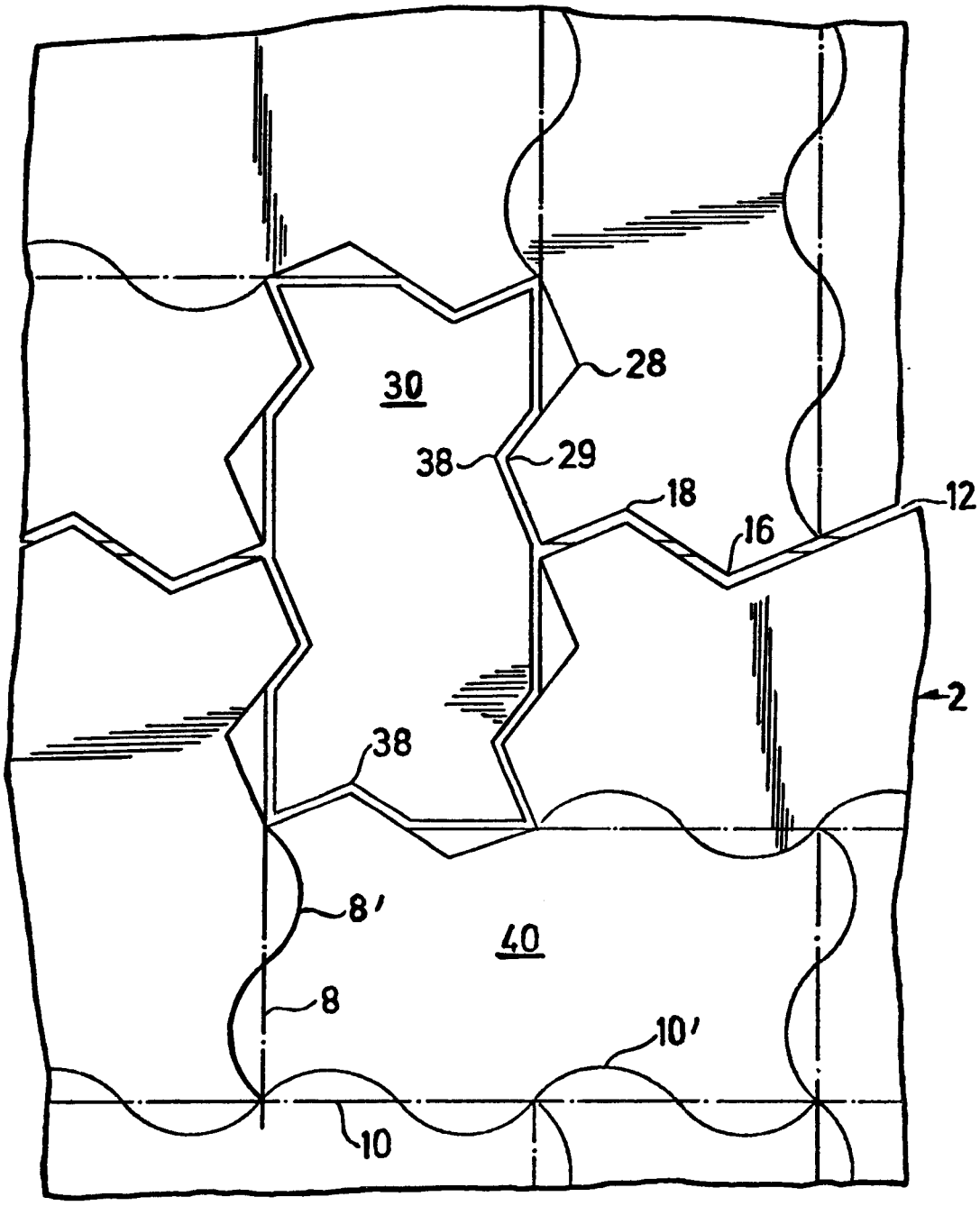
FIG. 17 shows an underneath plan view of a portion of a composite structure similar to that shown in FIG. 14, drawn to a larger scale.

The embodiment of the composite structure shown in FIG. 17 is very similar to that shown in FIGS. 14 to 16. In the case of the present embodiment however the entire inner contour of the recess 20 is provided with protuberances 29 which also serve as projections and with recessed parts 28 which also serve as withdrawn portions, so that the inner contour of the recess 20 corresponds to the contour of the lower zone of the laying unit 2, the protuberances 29 and recessed parts 28 being shaped to correspond to the protuberances 16 and the recessed parts 18. The inserted supplementing stone 30 on the other hand has only recessed parts 38 and can therefore be inserted from above into the facing recess 20 of the already placed laying unit 2. Instead of the protuberances 36 of the preceding embodiment, the contour of the supplementing stone in the present case has vertical contour faces; the recessed parts 28 perform no function in respect of the bonding effect. The second dummy jointing gaps 8', 10' which are associated with the first dummy jointing gaps 8,10 for providing inclined predetermined rupture zones 60 and which are disposed on the underside of the laying unit 2, extend in undulating manner, the undulations being of like size on both sides of the associated first dummy jointing gap 8 or 10.

Figure 18:
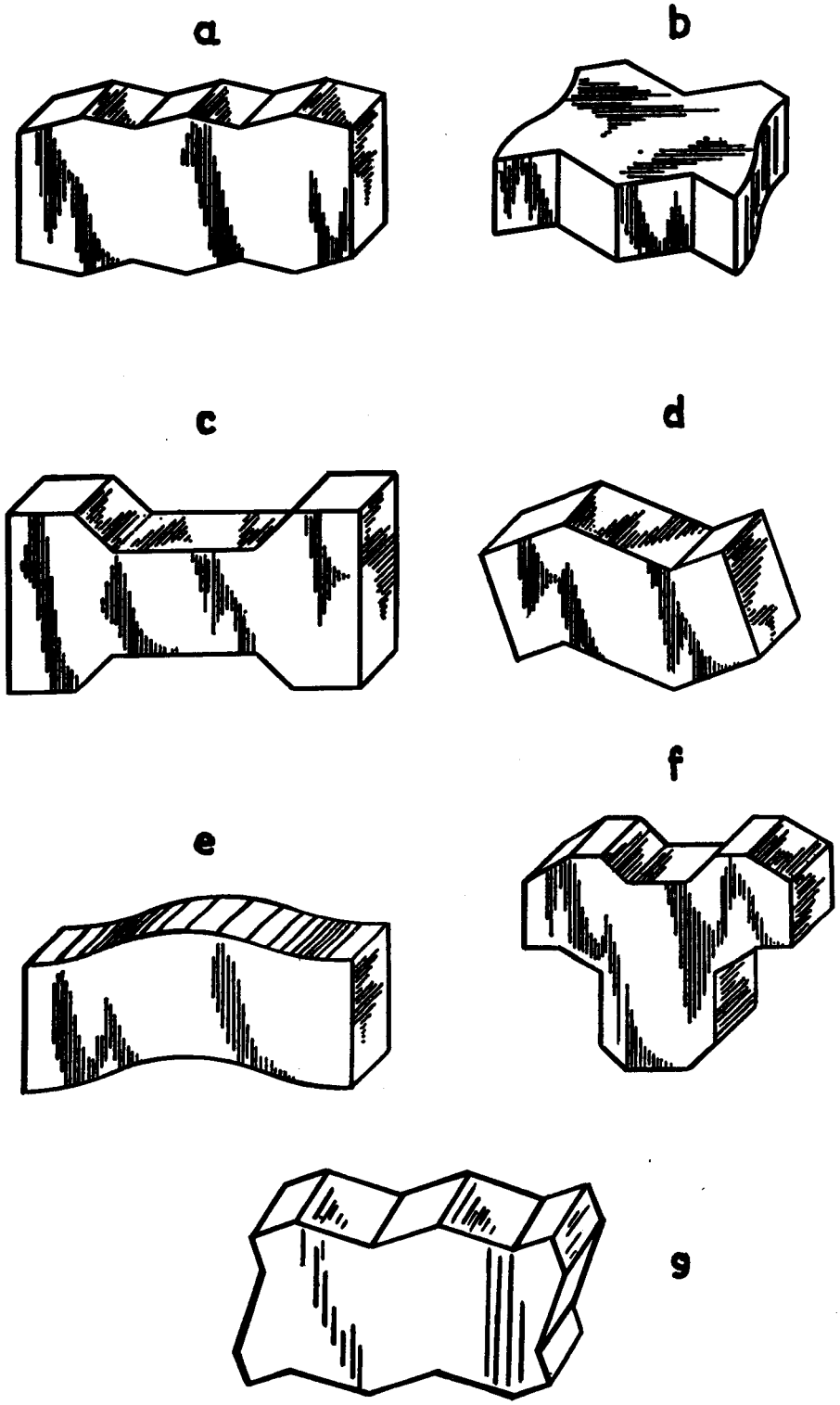
FIG. 18 shows in perspective several known stone shapes which may be adopted as the shape of the elements and of the supplementing stones.

FIG. 18 shows a selection of known shaped stones which can be used in connection with the invention as supplementing stones 30 or as indicative of the shape of the individual elements 40. In the case of (a), there is shown a shaped stone having two plane end faces and two undulating longitudinal faces which are axis-symmetrical relative to each other. The shaped stone shown at (b) has two opposite undulating end faces and two zig-zag-shaped longitudinal faces which are complementary and can be brought together by parallel displacement.

The shaped stone at (c) is of substantially double-T-shape and has two straight end faces.

The shaped stone shown in (d) has the shape of a distorted Z and is described more fully in German specification No. 960 359.

The interlocking stone shown under (e) has two plane end faces: the longitudinal faces are adapted to be brought together by parallel displacement relative to each other and have the shape of a central undulation adjoining two lateral half-undulations.

The shaped stone shown under (f) may be compared with the shape of a T having a curved recess in its upper central portion. All the corner edges, with the exception of the lower corners at the horizontal limb of the T are cut off by relatively large 45° chamfers. The shape of this shaped stone is described more fully in German specification No. 1,119,315.

The shaped stone shown at (g) has equal flat covering surfaces, a base line enclosing the equivalent of a pair of adjoining squares and side surfaces at the two pairs of vertically extending parallel stone sides, the side surfaces being disposed in zig-zag fashion about the base line and enclosing right angles at the corners of the stone and their reversal lines being equidistant from the base line and with like inclination to the base line forming equal angles therewith and in the middle of the long sides being of twice the length as at the stone corners, so that all side surfaces in every direction are inclined at the like angle to the base line. This shaped stone is more fully described in German specification No. 1,658,570.

Figure 19:
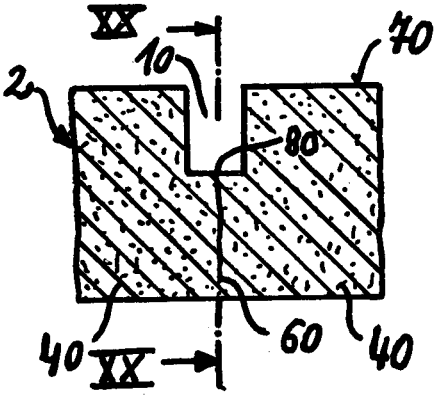
FIG. 19 shows a section through a laying unit wherein a free dummy jointing gap has been cut normal to the longitudinal direction thereof.

FIG. 19 shows a section through a laying unit 2 having a free open dummy jointing gap 10 extending from the upper side 70 of the laying unit. The dummy gap 10 has a rectangular profile as seen in cross-section. The cross-section could be of any other desired profile; similarly, the corners may be bevelled or rounded.

After the laying unit 2 has been laid at the predetermined location it is ruptured into its individual elements 40, for example by vibration from an eccentric-weight percussion device or due to stressing by traffic or also due to thermal stressing of the surface slab. Because of the presence of the dummy gap 10, rupture takes place along a predetermined rupture zone 60 extending from the bottom 80 of the dummy gap 60 to the opposite underside 72 of the laying unit 2.

FIGS. 20 to 24 show several embodiments in which the height or level of the dummy gap 60 varies in different ways along the length thereof. Although, in all the figures, a laying unit 2 is shown in which the dummy gap 10 extends from the upper side 70 into the interior of the laying unit 2, nevertheless this feature of the invention can in like manner be applied to laying units 2 in which a dummy gap extends from the underside 72 of the laying unit 2 or in which dummy gaps 10 are provided extending both from the upper side 70 and also from the underside 72. In the case of dummy gaps 10 being formed in both the upper side 70 and also in the underside 72, they may either be disposed vertically under each other, or they may be spaced laterally from each other whereby the predetermined rupture zone 60 forms an angle with the vertical.

Figure 20:
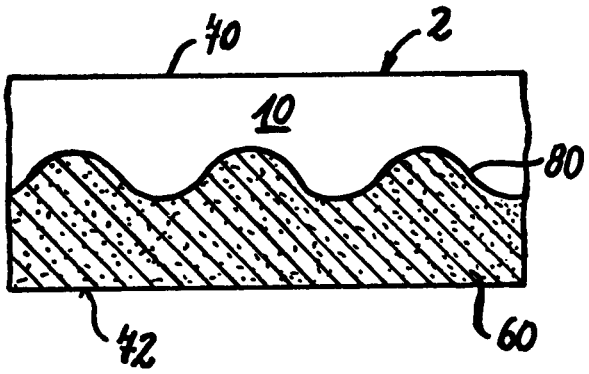
FIG. 20 is a longitudinal section taken along the line XX—XX in FIG. 19, through a predetermined rupture zone and a free dummy jointing gap the height or level of which varies lengthwise thereof.

In the case of the example of embodiment shown in FIG. 20, the bottom 80 of the dummy gap extends in undulating or corrugated configuration. This corrugated profile 80 may consist of a periodic succession of "undulations" of uniform height (as shown). The height and length of the undulations however may vary in regular or non-uniform manner if this would be of advantage for particular fields of application.

Figure 21:
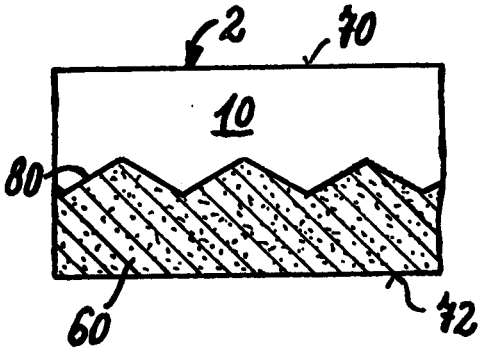
FIGS. 21 to 24 are longitudinal sections similar to that of FIG. 20, through further similar embodiments.

In the further embodiment shown in FIG. 21, the bottom 80 of the dummy gap 10 extends in the manner of regularly spaced serrations forming a zig-zag line. The height and spacing of these serrations can be selected within wide limits, depending on the intended purpose. Other non-uniform longitudinal profiles can readily be envisaged; in the case of this embodiment, a special characteristic resides in the formation of apices, extending upwardly and downwardly at the bottom 80 of the dummy gap 10.

Figure 22:
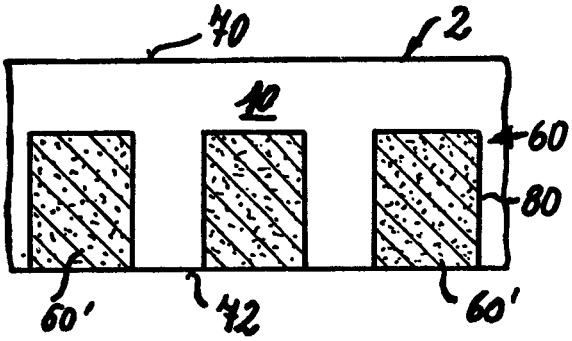

In the embodiment shown in FIG. 22, the height of the dummy gap 10 extends, in places, the entire height of the laying unit 2. Thereby, the predetermined rupture zone 60 is subdivided into a plurality of predetermined rupture sections 60'. The predetermined rupture sections 60' are equidistantly spaced from each other, in the example illustrated, but non-uniform spacings also are within the scope of the invention. In the case of the embodiment shown, the predetermined rupture sections 60' have a rectangular longitudinal profile 80.

Figure 23:
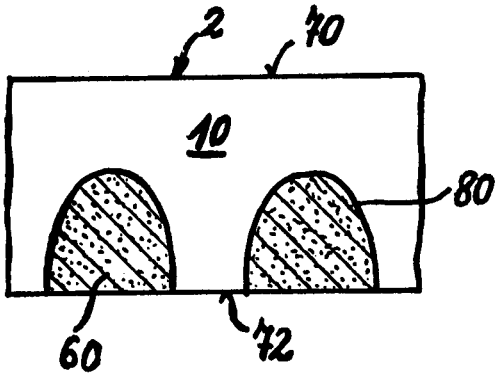
Figure 24:
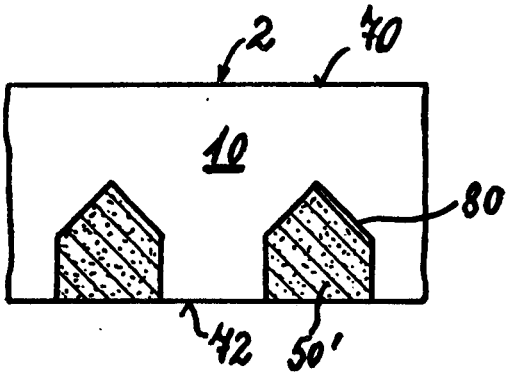

This longitudinal profile constituted by the bottom 80 of the dummy gap 10, of the individual predetermined rupture sections 60' can be varied in many ways. Thus FIG. 23 shows an embodiment wherein the longitudinal profiles are sections of an ellipse. The embodiment shown in FIG. 24 has longitudinal profiles 80 comprising vertical sections and sections that are inclined in the longitudinal direction, so that in longitudinal section the individual predetermined rupture zones 60' acquire the shape of a rectangle surmounted by a triangle.

The area occupied by the predetermined rupture zones 60 or the predetermined rupture sections 60' thereof (in longitudinal section) is so dimensioned that the laying unit has a sufficient stability for laying but can with certainty be divided into individual elements 40 by the methods described or similar methods. The ratio of the total longitudinal section area of the laying unit 2 to the area occupied by the predetermined rupture zones 60 or the predetermined rupture sections 60' depends inter alia on the size of the laying unit 2, on the strength of the material employed, and also on the geometrical shaping of the bottom 80 of the dummy gap 10.

Laying units 2 in which the height of the dummy gaps 10 varies along their length have been described above in schematic form with reference to a laying unit 2 having a single dummy gap 10 and two elements 40. It is to be understood that laying units can be constructed in accordance with the principles described having a plurality of dummy gaps 10 and elements 40, and in particular also laying units formed with recesses 20 at the periphery for receiving supplementing stones 30.

Figure 25:
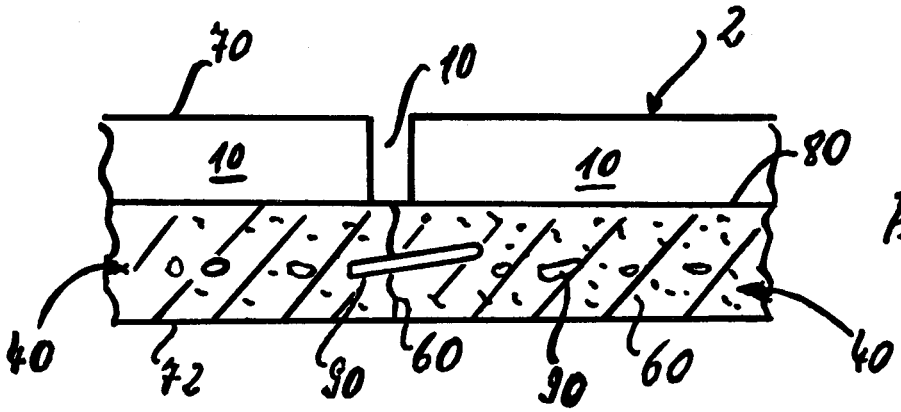
FIG. 25 shows a longitudinal section through a predetermined rupture zone and a free dummy jointing gap, with inserts of elongated material being provided at a predetermined height or level of the laying unit.

FIG. 25 shows a laying unit 2 having free open dummy jointing gaps 10 extending from the upper side 70 of the laying unit 2 and intersecting each other at right angles. From the bottom 80 of the dummy gaps 10 extend predetermined rupture zones 60 as far as the underside 72 of the laying unit 2. Approximately halfway up the predetermined rupture zones 60, inserts in the form of elongated material pieces 90 are provided in the laying unit 2. In the case of the embodiment shown these pieces are wire sections disposed with random orientation in the material of the laying unit 2. Moreover where greater demands are made on the reinforcing effect of the insert, the material pieces 90 can have a preferred orientation imparted to them transversely to the direction in which the predetermined rupture zones 60 extend. However, any material pieces 90 disposed transversely of the predetermined rupture zones 60 afford an anchoring connection of the elements 40 cohering by way of the predetermined rupture zones 60, thereby enhancing for example the resistance to breakage of the material of the laying unit 2 during transport or on laying. Additionally, also after rupture of the predetermined rupture zones 60, improved cohesion of the elements 40 is achieved.

To manufacture the laying unit 2 according to FIG. 25, the procedure is for example first of all to introduce a lower material layer for the laying unit 2 into a mold, then to sprinkle the material pieces 90 on to the introduced material layer from out of a container above the mold and then to introduce the remainder of the material for the laying unit 2 into the mold.

Figure 26:
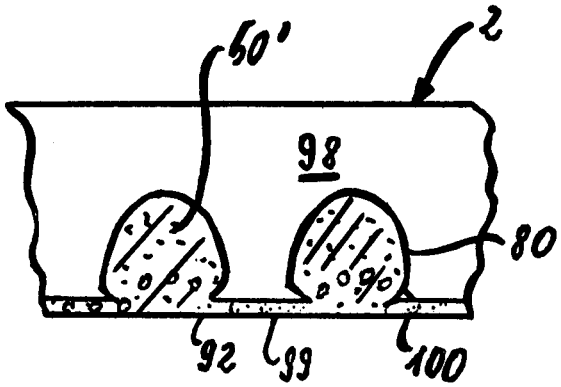
FIG. 26 is a longitudinal section through a predetermined rupture zone of a laying unit in the stage of formation of the dummy gap and into which an insert is pressed by a shaped element to produce the dummy gap.

FIG. 26 shows a laying unit 2 similar to the one described with reference to FIG. 23. An insert comprising threads 92 disposed parallel to each other, for example nylon or other plastics threads, extends along the entire laying unit 2 and in particular along the individual predetermined rupture zones 60'. The direction of these inserted threads 92 is preferably such that the two sides of the periphery of the laying unit 2 which are grasped on transport or on laying are connected with each other, thereby enhancing resistance to tensile stress in the direction in which maximum tensile stressing is to be expected.

To manufacture the laying unit 2 shown in FIG. 26, the mode of procedure is first of all to introduce the entire material required for the laying unit 2 into a mold and then to draw the threads 92 off for example from an appropriate roller or beam, and to lay them on to the material introduced into the mold. Then a shaped element in the form of a recessing plate 98 is lowered from above which enters the material of the laying unit 2 and presses the threads, with its zone projecting furthest forwardly on to the bottom of the mold. The filaments 92, however, which are not engaged by these zones projecting furthest forwardly are not pressed as far as the bottom of the mold but curve up and consequently pass through the predetermined rupture zones 60' at a height located above the bottom of the mold.

It will be appreciated that a thin layer of material of the laying unit 2 can be present below the zones 99 projecting furthest downwardly of the recessed plate 98. Such thin material layers are not to be excluded by the wording "dummy gap sections occupying the entire height of the laying unit".

The zones 99 projecting furthest downwardly of the recessing plate 98 are provided at their sides facing the predetermined rupture zones 60' with underengagement projections 100 having, in longitudinal section through the recessing plate 98, an outwardly inclined upper edge. These underengagement projections 100 serve for retaining the laying unit 2 in the mold frame after removal of the bottom of the mold. In plan view of the recessing plate 98 the underengagement projections are triangular in cross-section, and are formed on their upper side with an inclined cutting edge facing the particular predetermined rupture zones 60'. Then on extracting the recessing plate 98 the cutting edges displace the material of the laying unit 2 disposed above them, whereby predetermined rupture zones 60' are formed which are scored in their lateral marginal zones in the direction in which the recessing plate 98 is extracted from the mold.

Figure 27:
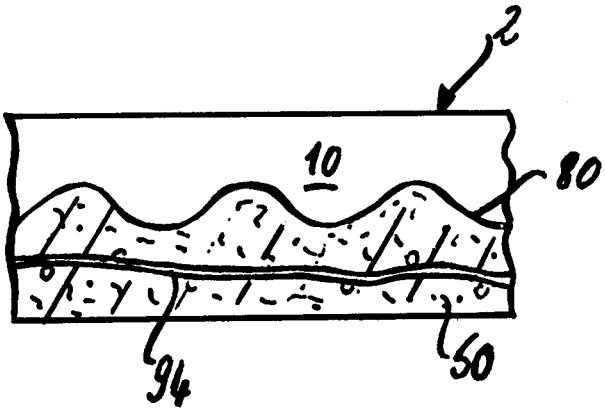
FIG. 27 shows a longitudinal section through a predetermined rupture zone and a free dummy gap of a laying unit, wherein a net-like insert is provided.

FIG. 27 shows a laying unit 2 similar to the one described with reference to FIG. 20. Substantially halfway up the predetermined rupture zone 60, the laying unit 2 has extending through it an insert in the form of a plaited or braided or woven structure 94 made from steel wire or plastics strands. This fabric is relatively wide-meshed and after introduction of a first material layer into a mold for the laying unit 2, the fabric can be wound off in especially simple manner from an appropriate supply roll and applied on the said first material layer, whereupon the remainder of the material for the laying unit 2 is introduced into the mold. Due to the wide mesh of the fabric, the two material layers readily bond to each other. The fabric 94 is a flexible three-dimensional structure affording on the one hand the desired enhanced resistance to tensile stress of the material of the laying unit 2 but on the other hand not hindering rupture of the predetermined rupture zone 60, for example after the processes described above. The strength of the fabric 94 can for example also be such that even when the predetermined rupture zones 60 have ruptured cohesion of the elements 40 is maintained.

The embodiments of the invention in which an exclusive property of privilege is claimed are defined as follows:

1. A composite paving structure for traffic areas or other graded or inclined ground surfaces, comprising an assembly of juxtaposed laying units and linking stones, each said laying unit being a relatively large unitary slab transportable as a unit by being gripped mechanically at opposite lateral sides thereof, said slab having preformed therein elongate rupture zones subdividing it into adjoined stones and along which after being laid it is breakable under stress into laterally interengaged individual stones, each said laying unit having in at least one lateral side thereof at least one recess extending its full height and substantially corresponding in facial shape and size to one said individual stone or a fraction or multiple thereof, each said unit being laid with at least one lateral side thereof lying at and along, and having therein at least one said recess each of which confronts a said recess in, a lateral side of at least one other said unit, each set of said confronting recesses being filled by at least one said linking stone inserted thereinto and which interconnects the respective juxtaposed laying units by extending across the gap between them, each said linking stone having the same height as the laying unit and having substantially the facial shape and size of one said individual stone or of a fraction or multiple thereof.

2. A paving structure according to claim 1, said linking stones and the respective sets of said recesses containing them, also said juxtaposed laying units, having on and along the respective adjacent sides thereof complementary, interengaged lateral projections and withdrawn portions which resist relative horizontal displacement of said linking stones and said laying units.

3. A paving structure according to claim 1, said linking stones and the respective sets of said recesses containing them, also said juxtaposed laying units, having on and along the respective adjacent sides thereof complementary, interengaged protuberances and recessed parts which respectively overlie one another and resist relative vertical displacement of said linking stones and said laying units.

4. A paving structure according to claim 1, said linking stones and the respective sets of said recesses containing them, also said juxtaposed laying units, having on and along adjacent sides thereof complementary, interengaged lateral projections and withdrawn portions which resist relative horizontal displacement of said linking stones and said laying units, and also complementary, interengaged protuberances and recessed parts which respectively overlie one another and resist relative vertical displacement of the same.

5. A paving structure according to claim 4, said projections and withdrawn portions being formed on and along lower regions only of said adjacent sides.

6. A paving structure according to claim 1, said linking stones and the respective sets of said recesses containing them, also said juxtaposed laying units and said individual stones as formed by said units breaking apart along said rupture zones, having on and along respective adjacent sides thereof complementary, interengaged lateral projections and withdrawn portions which resist relative horizontal displacement of the elements of said structure.

7. A paving structure according to claim 1, said linking stones and the respective sets of said recesses containing them, also said juxtaposed laying units and said individual stones as formed by said units breaking along said rupture zones, having on and along respective adjacent sides thereof complementary, interengaged lateral projections and withdrawn portions which resist relative horizontal displacement of the element of said structure, and also complementary, interengaged protuberances and recessed parts which respectively overlie one another and resist relative vertical displacement of the same.

8. A paving structure according to claim 1, said linking stones and the respective sets of said recesses containing them, also said juxtaposed laying units, having on and along the respective adjacent sides thereof complementary, interengaged lateral projections and withdrawn portions which resist relative horizontal displacement of said linking stones and said laying units, said juxtaposed laying units also having on and along the respective adjacent sides thereof complementary, interengaged protuberances and recessed parts which respectively overlie one another and resist relative vertical displacement of said units.

9. A paving structure according to claim 1, said juxtaposed laying units having on and along the respective adjacent sides thereof complementary, interengaged protuberances and recessed parts which respectively overlie one another and resist relative vertical displacement of said units.

10. A paving structure according to claim 1, said individual stones as formed by said laying units breaking along said rupture zones, together with said linking stones, constituting a pattern of interengaged stones that continues without substantial interruption from each into the next of said juxtaposed laying units.

11. A paving structure according to claim 1 each said laying unit being quadrilateral in contour and having at least one said recess in each lateral side thereof.

12. A paving structure according to claim 1, each said laying unit being quadrilateral in contour and having at least one said recess in each of at least two opposite sides thereof, the respective contours of said opposite sides being in mirror image relation.

13. A paving structure according to claim 1, said linking stones and said individual stones all having substantially the same facial shape and size.

14. A paving structure according to claim 1, each said laying unit being laid in staggered relation to an adjacent laying unit.

15. A paving structure according to claim 1, each of said individual stones as formed by said laying units breaking along said rupture zones, also each of said linking stones, having a quadrilateral contour that is centrosymmetrical and covers an area approximately twice as long as it is wide, and having on and along its four sides lateral projections and withdrawn portions which form at opposite sides of the stone configurations that, by parallel translation of such sides, are substantially identical.

16. A paving structure according to claim 1, at least one of said rupture zones in each said slab being defined by a dummy gap formed in and continuously along the upper and/or lower side of the slab.

17. A paving structure according to claim 16, said dummy gap being varied in height along its length.

18. A paving structure according to claim 1, at least one of said rupture zones in each said slab being constituted by a series of rupture sections therein which are each separated from another by a dummy gap extending through the entire height of the slab at locations between said rupture sections.

19. A paving structure according to claim 1, at least one said laying unit having embedded therein at least one flexible tying insert extending from within at least one stone thereof into an adjacent stone thereof across the rupture zone therebetween.

20. A paving structure according to claim 1, said rupture zones and said recesses and linking stones being so disposed in said slabs that said individual stones and said linking stones form a herringbone pattern extending from one laying unit into another, with a shorter side of each stone lying adjacent to part of a longer side of another stone.

21. A paving structure according to claim 1, said laying units being substantially quadrilateral and substantially the same in contour and each of them having at least one said recess in each of its lateral sides, said units being laid in offset pattern with a shorter side of one unit lying adjacent to and interconnected by at least one said linking stone with a shorter side of another unit, and with a longer side of a third unit lying adjacent to and interconnected by at least one said linking stone with part of a longer side of said one unit and part of a longer side of said other unit.

22. A structure according to claim 1, said laying units and said linking stones each being a molding of concrete.

23. A paving structure according to claim 1, at least some of said linking stones having substantially the facial shape and size of a multiple of said individual stones and having preformed therein at least one elongate rupture zone along which after being layed it is breakable under stress into laterally engaged stones extending across said gap and each substantially corresponding in facial shape and size to one of said individual stones.

24. A composite paving structure for traffic areas or other graded or inclined ground surfaces, comprising an assembly of juxtaposed laying units and concrete linking stones, each said laying unit being a relatively large unitary slab of concrete transportable as a unit by being gripped mechanically at opposite lateral sides thereof, said slab having preformed therein elongate rupture zones subdividing it into adjoined stones and along which after being laid it is breakable under stress into laterally interengaged individual stones, each said laying unit having in at least one lateral side thereof at least one recess extending its full height and substantially corresponding in facial shape and size to one said individual stone or a fraction or multiple thereof, each said unit being laid with at least one lateral side thereof lying at and along, and having therein at least one said recess each of which confronts a said recess in, a lateral side of at least one other said unit, each set of said confronting recesses being filled by at least one said linking stone inserted thereinto and which interconnects the respective juxtaposed laying units by extending across the gap between them, each said linking stone having the same height as said laying units, each of said individual stones as formed by said laying units breaking along said rupture zones, also each of said linking stones, having quadrilateral contour that is centrosymmetrical and covers an area approximately twice as long as it is wide, and having on and along its four sides lateral projections and withdrawn portions which form at opposite sides of the stone configurations that, by parallel translation of such sides, are identical, said individual stones together with said linking stones constituting a herringbone pattern of interengaged stones that extends without substantial interruption from each into the next of said juxtaposed laying units, with a shorter side of each stone lying adjacent to half of a longer side of another stone.

25. A paving structure according to claim 24, said rupture zones in each said slab being each defined by a dummy gap formed in and continuously along the upper side of the slab.

26. A paving structure according to claim 24, said rupture zones in each said slab being each constituted by a series of rupture sections therein which are each separated from another by a dummy gap extending through the entire height of the slab at locations between said rupture sections.

27. A laying unit for a composite paving structure, comprising a relatively large unitary paving slab that is transportable and layable as a unit upon a ground surface by being gripped mechanically at opposite lateral sides thereof, said slab having preformed therein a multiplicity of elongate rupture zones subdividing it into adjoined stones and along which after being laid it is breakable under stress into laterally interengaged individual stones, said slab having in at least one lateral side thereof at least one recess extending its full height and corresponding in facial shape and size to one of said individual stones or a whole number fraction thereof, said rupture zones being so disposed that said individual stones form a herringbone pattern wherein a shorter side of each such stone lies adjacent to part of a longer side of another such stone.

28. A laying unit according to claim 27, said rupture zones each being constituted by a series of rupture sections formed in said slab and separated each from another by a dummy gap and extending through its entire height at locations between said rupture sections.

29. A laying unit for a composite paving structure, comprising a relatively large unitary paving slab that is transportable and layable as a unit upon a ground surface by being gripped mechanically at opposite lateral sides thereof, said slab having preformed therein a multiplicity of elongate rupture zones subdividing it into adjoined stones and along which after being laid it is breakable under stress into laterally interengaged individual stones, said slab having in at least one lateral side thereof at least one recess extending its full height and corresponding in facial shape and size to one of said individual stones or a whole number fraction thereof, said individual stones as formed by said slab breaking along said rupture zones having on and along adjacent sides thereof complementary, interengaged protuberances and recessed parts which respectively overlie one another and resist relative vertical displacement of said individual stones.

30. A laying unit according to claim 29, said individual stones also having on and along adjacent sides thereof complementary, interengaged lateral projections and withdrawn portions which resist relative horizontal displacement thereof.

31. A laying unit according to claim 30, said lateral projections and withdrawn portions being formed on and along lower regions only of said adjacent sides.

32. A laying unit for a composite paving structure, comprising a relatively large unitary paving slab that is transportable and layable as a unit upon a ground surface by being gripped mechanically at opposite lateral sides thereof, said slab having preformed therein a multiplicity of elongate rupture zones subdividing it into adjoined stones and along which after being laid it is breakable under stress into laterally interengaged individual stones, said slab having in at least one lateral side thereof at least one recess extending its full height and corresponding in facial shape and size to one of said individual stones or a whole number faction thereof, said rupture zones each being defined by a dummy gap formed in and continuously along the upper and/or lower side of said slab, said dummy gap being varied in height lengthwise thereof.

33. A laying unit for a composite paving structure, comprising a relatively large unitary paving slab that is transportable and layable as a unit upon a ground surface by being gripped mechanically at opposite lateral sides thereof, said slab having preformed therein a multiplicity of elongate rupture zones subdividing it into adjoined stones and along which after being laid it is breakable under stress into laterally interengaged individual stones, said slab having in at least one lateral side thereof at least one recess extending its full height and corresponding in facial shape and size to one of said individual stones or a whole number faction thereof, each said rupture zone being constituted by a series of rupture sections formed in said slab and separated one from another by dummy gaps extending through the entire height of said slab at locations between said rupture sections, said adjoined stones being each connected to at least another by a plurality of said rupture sections.

34. A laying unit for a composite paving structure, comprising a relatively large unitary paving slab that is transportable and layable as a unit upon a ground surface by being gripped mechanically at opposite lateral sides thereof, said slab having preformed therein a multiplicity of elongate rupture zones subdividing it into adjoined stones and along which after being laid it is breakable under stress into laterally interengaged individual stones, said slab having in at least one lateral side thereof at least one recess extending its full height and corresponding in facial shape and size to one of said individual stones or a whole number faction thereof, said slab having embedded therein at least one flexible tying insert extending from within at least one stone thereof into an adjacent stone thereof across the rupture zone therebetween.

35. A laying unit according to claim 34, said insert extending through the whole of said slab.

36. A laying unit for a composite paving structure, comprising a relatively large slab that is transportable and layable as a unit upon a ground surface by being gripped mechanically at opposite lateral sides thereof, said slab having preformed therein a multiplicity of elongate rupture zones subdividing it into adjoined stones and along which after being laid it is breakable under stress into laterally interengaged individual stones, said rupture zones being so disposed that said individual stones form a herringbone pattern wherein a shorter side of each such stone lies adjacent to part of a longer side of another such stone.

37. A laying unit according to claim 36, each of the stones defined by said rupture zones having a quadrilateral contour that is centrosymmetrical and covers an area approximately twice as long as it is wide, and having on and along its four sides lateral projections and withdrawn portions which form at opposite sides of the stone configurations that, by parallel translation of said sides, are identical.

38. A composite paving structure for traffic areas or other graded or inclined ground surfaces, comprising an assembly of juxtaposed laying units, each said laying unit being a relatively large slab of concrete that is transportable as a unit by being gripped mechanically at opposite lateral sides thereof, said slab having preformed therein elongate rupture zones subdividing it into adjoined stones and along which after being laid it is breakable under stress into laterally interengaged individual stones, each said laying unit being laid with at least one lateral side thereof lying at and along a lateral side of at least one other said laying unit, said rupture zones being so disposed in each said unit and said units being so juxtaposed that the individual stones formed by said units breaking along said rupture zones constitute a herringbone pattern of interengaged stones that extends from each into the next of said laying units with a shorter side of each stone lying adjacent to part of a longer side of another stone.

39. A composite paving structure according to claim 38, each of said individual stones having a quadrilateral contour that is centrosymmetrical and covers an area approximately twice as long as it is wide, and having on and along its four sides lateral projections and withdrawn portions which form at opposite sides of the stone configurations that, by parallel translation of said sides, are identical.

40. A composite paving structure according to claim 38, each said laying unit having in each of at least two opposite lateral sides thereof at least one recess extending the full height of the laying unit and substantially corresponding in facial shape and size to a half of one of said individual stones, said laying units being laid with at least one said recess in a lateral side of each of them confronting a said recess in a lateral side of another of them, each set of said confronting recesses being filled by a linking stone having the same height as the laying units and which interconnects the respective adjacent laying units by extending across the gap between them, each said linking stone having the shape of said individual stones and forming an element of said herringbone pattern.

41. A composite paving structure according to claim 40, each of said individual stones and each said linking stone having a quadrilateral contour that is centrosymmetrical and covers an area approximately twice as long as it is wide, and having on and along its four sides lateral projections and withdrawn portions which form at opposite sides of the stone configurations that, by parallel translation of said sides, are identical.

* * * * *

UNITED STATES PATENT OFFICE

CERTIFICATE OF CORRECTION

Patent No. 4,016,692 Dated April 12, 1977

Inventor(s) Reinhard Jordan

It is certified that error appears in the above-identified patent and that said Letters Patent are hereby corrected as shown below:

Column 5, line 12, in place of "or" read -- of --.

Column 7, line 53, insert a comma after "can".

Column 8, line 10, in place of "knotted" read -- knitted --.

Column 12: Line 9, in place of "joining" read -- jointing --
Line 24, in place of "band" read -- bond --
Line 40-41, in place of "chambers" read -- chamfers --.

Column 19, line 8, in place of "of" read -- or --.

Column 23, line 29, in place of "of" read -- or --.

Column 26, line 62, delete "and".

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*